US007272946B2

(12) United States Patent
Ichigaya

(10) Patent No.: US 7,272,946 B2
(45) Date of Patent: Sep. 25, 2007

(54) COOLING CLOTHES

(75) Inventor: Hiroshi Ichigaya, Minami-ku (JP)

(73) Assignee: Seft Development Laboratory Co., Ltd., Saitama-shi (JP)

( * ) Notice: Subject to any disclaimer, the term of this patent is extended or adjusted under 35 U.S.C. 154(b) by 189 days.

(21) Appl. No.: 10/519,953

(22) PCT Filed: Jul. 10, 2002

(86) PCT No.: PCT/JP02/07021

§ 371 (c)(1),
(2), (4) Date: Sep. 14, 2005

(87) PCT Pub. No.: WO2004/006699

PCT Pub. Date: Jan. 22, 2004

(65) Prior Publication Data

US 2006/0080987 A1 Apr. 20, 2006

(51) Int. Cl.
*F25D 23/12* (2006.01)

(52) U.S. Cl. ..... 62/259.3; 62/3.5

(58) Field of Classification Search ..... 62/3.5, 62/259.3, 304; 2/DIG. 1
See application file for complete search history.

(56) References Cited

U.S. PATENT DOCUMENTS 4,185,327 A * 1/1980 Markve ..... 2/458
5,014,355 A * 5/1991 Vollenweider, II ..... 2/79
5,255,390 A * 10/1993 Gross et al. ..... 2/458
5,433,083 A * 7/1995 Kuramarohit ..... 62/259.3
5,533,354 A * 7/1996 Pirkle ..... 62/259.3
6,823,678 B1 * 11/2004 Li ..... 62/3.5

FOREIGN PATENT DOCUMENTS

| | | |
|---|---|---|
| JP | 143516/1988 | 9/1988 |
| JP | 4-209809 A | 7/1992 |
| JP | 2001-40512 A | 2/2001 |
| WO | WO 00/06006 A | 2/2000 |

* cited by examiner

*Primary Examiner*—Melvin Jones
(74) *Attorney, Agent, or Firm*—Crowell & Moring LLP

(57) ABSTRACT

The present invention provides a cooling suit for allowing comfortable feeling even with a lesser power consumption and a simple structure. The cooling suit includes a cloth part 10*a* having an upper portion made of a highly air-permeable material, and having those portions other than the upper portion which are made of a substantially air-impermeable material. Formed at a reverse surface of the cloth part 10*a* are airflow passages between the cloth part 10*a* and an undergarment. Provided at a lower portion of the cloth part 10*a* are air outlets 50*a* for extracting air-streams within the airflow passages to the exterior; and provided at those positions of the reverse side of the cloth part 10*a* which correspond to the air outlets 50*a*, are fans for forcibly causing the air-streams within the airflow passages. Outside air is introduced into the airflow passages through the upper portion of the cloth part 10*a* by the fans, and the air-streams are flowed within the airflow passages in a manner substantially parallel to the wearer's body surface, so that the wearer's body is cooled.

18 Claims, 13 Drawing Sheets a b a b c

COOLING CLOTHES

TECHNICAL FIELD

The present invention relates to a cooling suit for allowing comfortable feeling even in environments at higher temperatures.

BACKGROUND ART

Currently, air conditioners are widespread most, as means for overcoming hotness in hot seasons such as summer. Such air conditioners are extremely effective in overcoming hotness, since they are to directly cool the air in the rooms.

However, air conditioners are so expensive that they have not been yet installed in every room of a household, though the spread rate of air conditioners to households has been increased in itself. Further, since air conditioners consume a lot of electric power, the spread of air conditioners: increases the electric power consumption of the whole society; and causes a disappointed result of warming the whole earth under the circumstances that the major part of power generation relies on fossil fuels. Moreover, air conditioners for directly cooling the air in the rooms may cause a problem of health damage due to overcooling.

Thus, the above problems will be solved to a certain extent, by working out such clothes for allowing comfortable feeling even in hot seasons with a lesser power consumption.

DISCLOSURE OF THE INVENTION

The present invention has been carried out in view of such technical circumstances, and it is therefore an object of the present invention to provide a cooling suit for allowing comfortable feeling even with a lesser power consumption and a simple structure.

To achieve the above object, the present invention provides a cooling suit to be worn on a wearer, comprising:

a cloth part;

at least one air inlet provided at said cloth part and configured to introduce outside air into the interior of said cloth part;

at least one air outlet provided at said cloth part and configured to extract the air within the interior of said cloth part to the exterior;

at least one air-blowing means for discharging the air in a space between said cloth part and the wearer's body or an undergarment to the exterior, thereby forcibly causing air-streams within said space;

at least one clearance holding means, provided to cover that surface of the or each air-blowing means which opposes to the wearer's body or to the undergarment, and configured to hold a predetermined clearance between the or each air-blowing means and the wearer's body or the undergarment;

electric-power source means for supplying electric power to the or each air-blowing means; and air-leakage preventing means for preventing the air-streams flowing between said cloth part and the wearer's body or the undergarment, from leaking to the exterior from a lower end of said cloth part;

wherein the or each air-blowing means introduces the outside air into the interior of said cloth part through the or each air inlet to cause the introduced air to flow within said space and substantially parallelly to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away an evaporation heat from the surroundings upon evaporation of the perspiration.

Moreover, to achieve the above object, the present invention provides a cooling suit to be worn on a wearer, comprising:

a cloth part;

at least one air inlet provided at a lower portion of said cloth part and configured to introduce outside air into the interior of said cloth part;

at least one air outlet provided at an upper portion of said cloth part and configured to extract the air within the interior of said cloth part to the exterior;

at least one sideward-flow fan configured to feed outside air into a space between said cloth part and the wearer's body or an undergarment, thereby forcibly causing air-streams within said space;

electric-power source means for supplying electric power to the or each air-blowing means; and air-leakage preventing means for preventing the air-streams flowing between said cloth part and the wearer's body or the undergarment, from leaking to the exterior from a lower end of said cloth part;

wherein the or each sideward-flow fan introduces the outside air into the interior of said cloth part through the or each air inlet to cause the introduced air to flow within said space and substantially parallelly to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away an evaporation heat from the surroundings upon evaporation of the perspiration.

Furthermore, to achieve the above object, the present invention provides a cooling suit to be worn on a wearer, comprising:

a cloth part;

at least one air-flow opening provided at said cloth part and configured to extract air within the interior of said cloth part or to introduce outside air into the interior of said cloth part;

at least one air-blowing means, provided at that position of said cloth part which corresponds to the or each air-flow opening, and configured to forcibly cause air-streams in a space between said cloth part and the wearer's body or an undergarment;

electric-power source means for supplying electric power to the or each air-blowing means; and an air-permeating region which is a predetermined region of said cloth part positioned oppositely to the or each air-flow opening across said space and which is made of a highly air-permeable material;

wherein the or each air-blowing means introduces the outside air into said space through the or each air-flow opening or through said air-permeating region to cause the introduced air to flow within said space and substantially parallelly to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away an evaporation heat from the surroundings upon evaporation of the perspiration.

Further, to achieve the above object, the present invention provides a cooling suit to be worn on a wearer, comprising:

a cloth part;

partitioning means for partitioning a space between said cloth part and an undergarment into upper and lower partial spaces;

at least one air-blowing means, provided at said partitioning means, and for forcibly causing air-streams within said space between said cloth part and the wearer's body or the undergarment;

electric-power source means for supplying electric power to the or each air-blowing means; and an air ventilating portion, provided at least one of an upper portion and a lower portion of said cloth part, and configured to extract the air-streams within said space to the exterior or to introduce outside air into said space;

wherein the or each air-blowing means introduces the outside air into said space through said air ventilating portion or through an end portion of said cloth part to cause the introduced air to flow within said space and substantially parallelly to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away an evaporation heat from the surroundings upon evaporation of the perspiration.

Note that the term "undergarment" means those garments to be worn inside the cooling suit.

BEST MODE FOR CARRYING OUT THE INVENTION

There will be described hereinafter the best mode for carrying out the invention according to the present application, with reference to the accompanying drawings.

Figure 3:
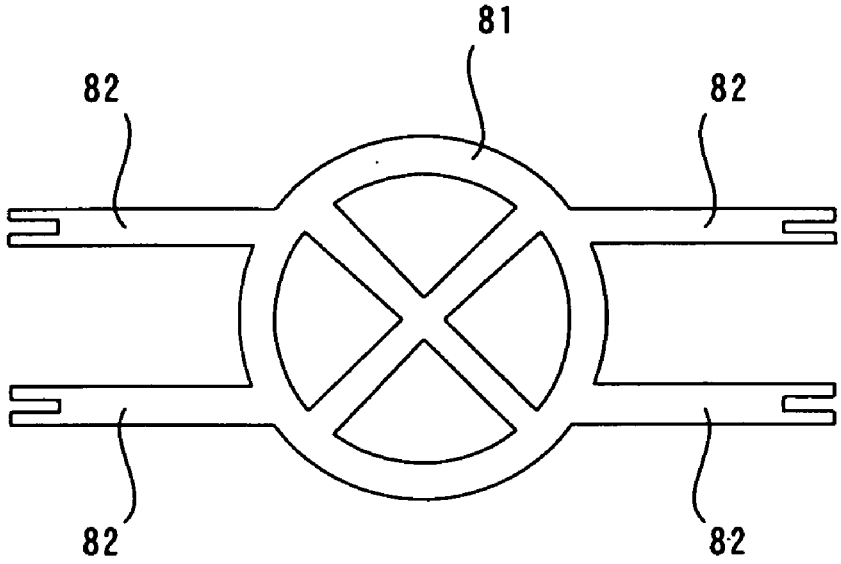
FIG. 3*a* is a schematic plan view of clearance holding means to be used in the cooling suit.
FIG. 3*b* is an enlarged schematic plan view of a leg portion of the clearance holding means.
Figure 3:
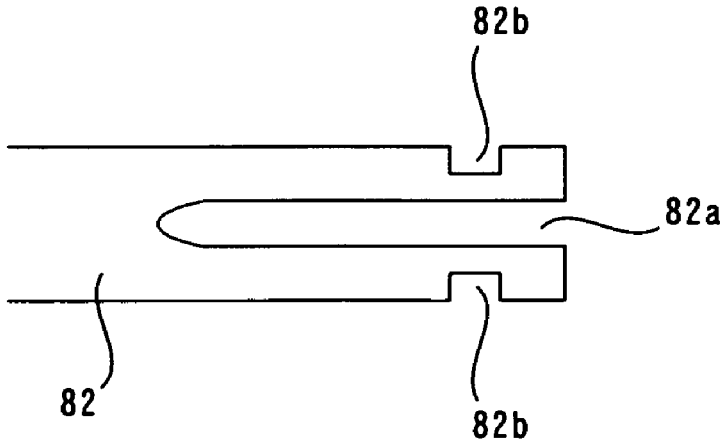
Figure 4:
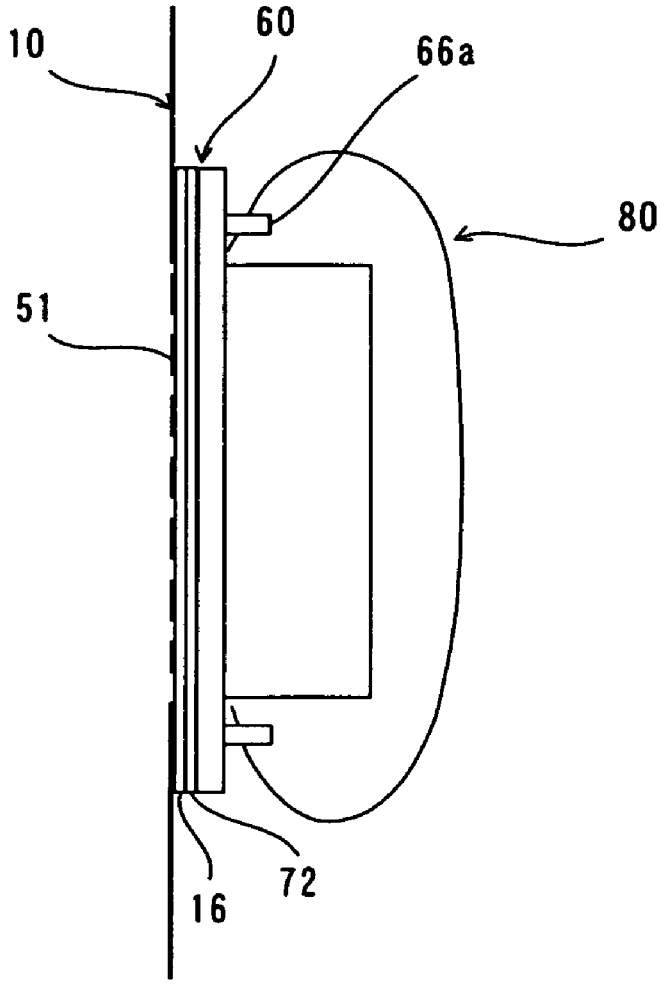
FIG. 4 is a view explaining a situation where the fan is attached to a cloth part.
Figure 5:
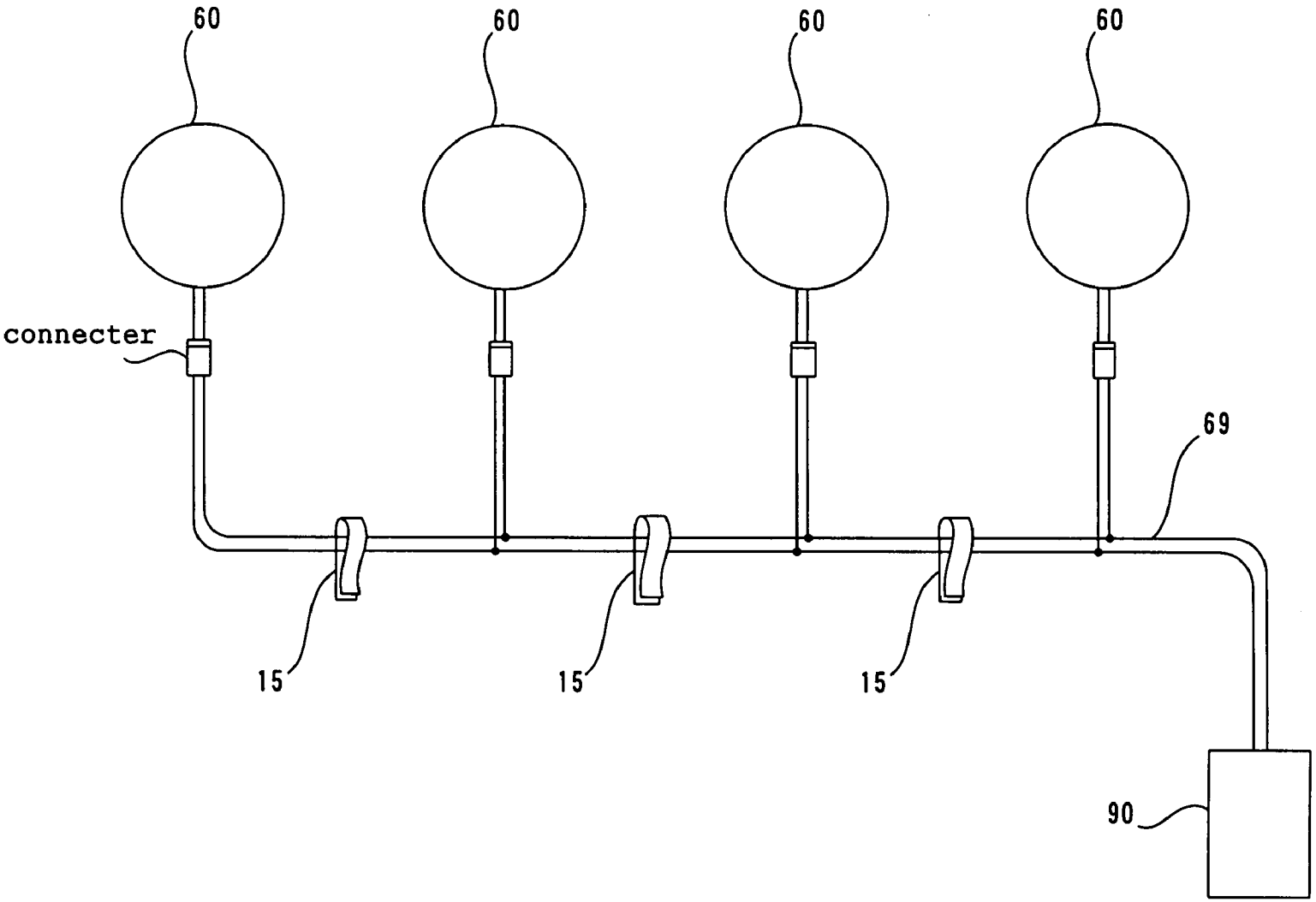
FIG. 5 is a view explaining a manner for fixing connecting cords of four fans.

There will be firstly explained hereinafter a cooling suit according to a first embodiment of the present invention. FIG. 1*a* is a schematic front view of a cooling suit according to a first embodiment of the present invention, and FIG. 1*b* is a schematic rear view of the cooling suit; FIG. 2*a* is a schematic plan view of a fan to be used in the cooling suit, FIG. 2*b* is a schematic side view of the fan, and FIG. 2*c* is a schematic bottom view of the fan. FIG. 3*a* is a schematic plan view of clearance holding means to be used in the cooling suit, and FIG. 3*b* is an enlarged schematic plan view of a leg portion of the clearance holding means; FIG. 4 is a view explaining a situation where the fan is attached to a cloth part; and FIG. 5 is a view explaining a manner for fixing connecting cords of four fans.

Figure 1:
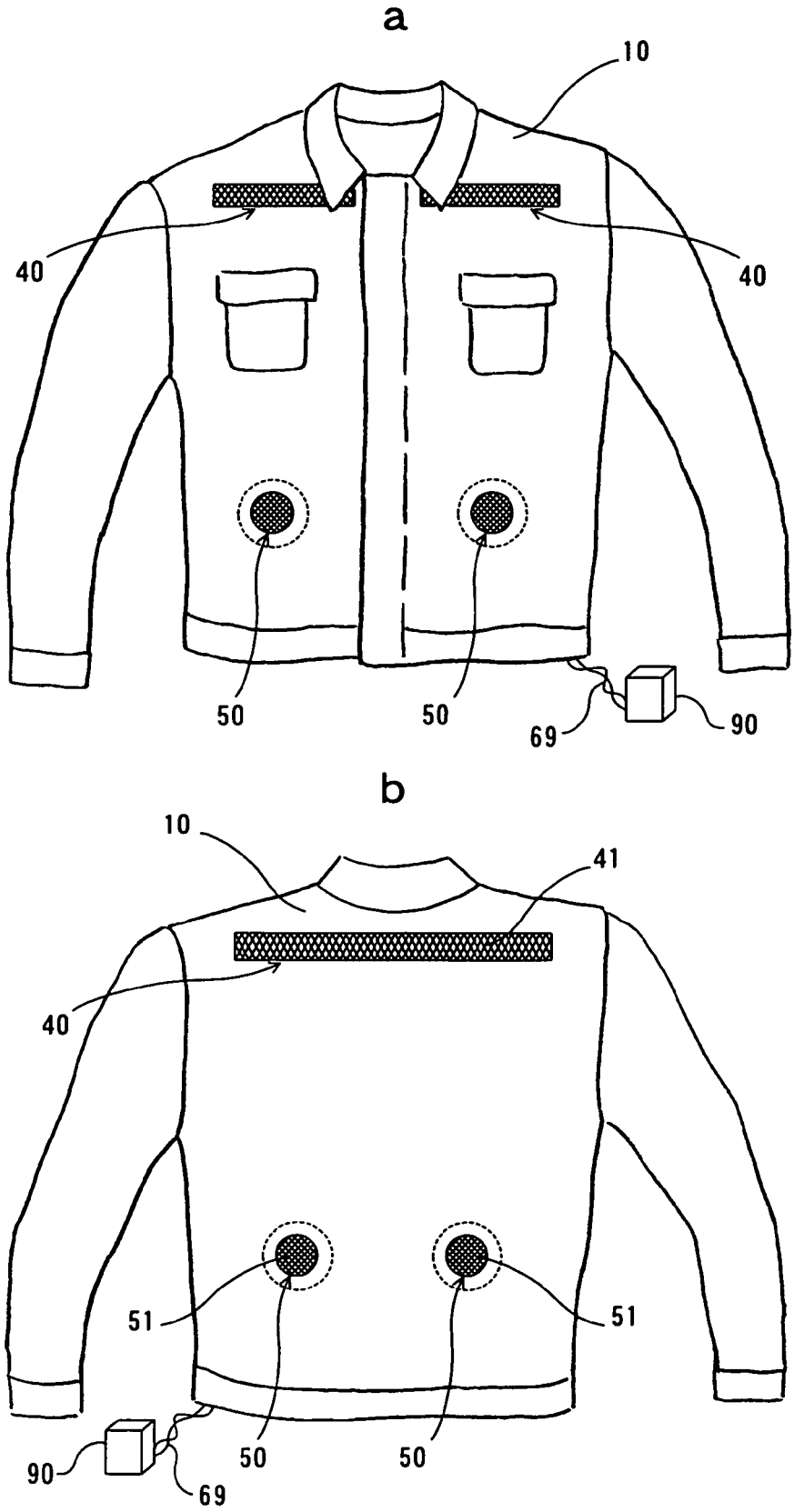
FIG. 1*a* is a schematic front view of a cooling suit according to a first embodiment of the present invention.
FIG. 1*b* is a schematic rear view of the cooling suit.

As shown in FIG. 1 and FIG. 4, the cooling suit of the first embodiment comprises: a cloth part 10; three air inlets 40; four air outlets 50; four fans (air-blowing means) 60; four pieces of clearance holding means 80; an electric-power source box 90; and air-leakage preventing means (not shown). The first embodiment will be described hereinafter concerning a situation that such a cooling suit is applied to or embodied as clothes such as work suits, uniforms and the like of a type where the clothes are worn without bringing bottom portions thereof into the trousers. This cooling suit is to be a long-sleeved one of a type having a front portion to be closed by a fastener. Further, this cooling suit is worn on an undergarment. In the first embodiment, those garments to be worn inside the cooling suit shall be called an "undergarment" herein. For example, in wearing a dress shirt under the cooling suit, the dress shirt is an "undergarment" defined herein.

Used in the first embodiment is a fastener as means for closing the front portion of the worn cooling suit. Although buttons, hooks or the like may be used, it is desirable to use fasteners. This is because, fasteners are readily opened and closed, and substantially no air is leaked to the exterior through fasteners once the fasteners are closed. Thus, closing the fastener defines airflow passages between the cloth part 10 and the undergarment. Namely, the term "airflow passages" refer to spaces to be defined at substantially fixed positions between the cloth part and undergarment such as depending on a suit shape, a cloth material, a suit size, and a wearing manner, and at occasional positions such as depending on movements of a wearer's body. Forcibly flowing outside air into the airflow passages, causes airflows between the undergarment and the cloth part in a manner substantially parallel to the wearer's body, with positional irregularities. In this respect, even when positional irregularities are existent, thinner clearances rather lead to generally faster airflows and lead to airstreams closer to the wearer's body, thereby occasionally causing a rather increased cooling effect, so that differences of cooling effects due to irregularities of clearances are not so increased.

The air inlets 40 are formed near an upper end portion of the cloth part 10. The air inlets 40 have sufficiently large lateral widths, respectively. Each air inlet 40 is formed by exemplarily cutting out a predetermined portion of the cloth part 10 and by stitching a mesh-like material 41 onto the cut out portion from the reverse surface side of the cloth part 10. The mesh-like material 41 is provided to reduce an incongruent feeling in the external appearance of the cooling suit. Outside air from such air inlets 40 flows into the airflow passages. In the embodiment of FIG. 1, the air inlets 40 are totally provided at three in number, including two at the front side and one at the rear side of the upper portion of the cloth part 10. Note that the neck and cuff portions can also be regarded as air inlets, in a broad sense.

Meanwhile, the air outlets 50 are formed at those predetermined positions of the cloth part 10, which correspond to lower end portions of the airflow passages, respectively. Also these air outlets 50 are formed in the same manner as the air inlets 40, for example. Namely, each air outlet is formed by exemplarily cutting out a predetermined portion of the cloth part 10 and by stitching a mesh-like material 51 onto the cut out portion from the reverse surface side of the cloth part 10. The mesh-like material 51 is provided to reduce an incongruent feeling in the external appearance of the cooling suit. The air within the airflow passages outflows through such air outlet 50. The number of air outlets 50 is the same as the number of fans 60. In the example of FIG. 1, the air outlets 50 are totally provided at four in number, including two at the front side and two at the rear side of the lower portion of the cloth part 10.

The four fans 60 are provided to forcibly cause air-streams within the airflow passages, and mounted at those positions on the reverse surface of the cloth part 10 which correspond to the air outlets 50, respectively. Namely, the fans 60 are totally provided at four including two at the front side and two at the rear side of the lower portion of the cloth part 10. These fans 60 are rotated in directions for discharging the air-streams within the airflow passages, respectively. Rotating the fans 60 in these directions lowers pressures within the airflow passages, thereby causing outside air to flow into the airflow passages through the air inlets 40. These inflowing air-streams move within the airflow passages, along downward directions parallel to the wearer's body surface, respectively. Further, upon reaching the fans 60, the air-streams are sucked by the associated fans 60 and discharged to the exterior through the associated air outlets 50, respectively. Note that, since the pressure difference between the interior and exterior of the cooling suit is small even in the above described manner for outwardly discharging the air-streams within the airflow passages, the cloth of the suit is never closely contacted with the undergarment due to such a pressure difference insofar as the cloth is of a general type. Further, even when the cloth part and the undergarment are contacted with each other due to partial creases of the cloth so that the air-streams are not allowed to pass through the contacted portions, both the temperature and the humidity are rapidly spread insofar as the surface areas of the contacted portions are not so large. It is of course possible to positively ensure a space, such as by using a relatively rigid cloth, or by devising the shape of the cloth part. However, problems concerning design and cost may be caused then. Meantime, it is naturally possible to sufficiently ensure flow passages required for cooling, even in adopting commercially available normal cloths. Only, it is disadvantage to use materials having higher elasticity as cloths, because the cloth part and the undergarment will be then closely contacted with each other to thereby make it difficult to ensure a due space.

As shown in FIG. 5, the four fans 60 are electrically connected to each other in parallel, and have connecting cords 69 electrically connected to the electric-power source box 90. Accommodated within the electric-power source box 90 is a battery (electric-power source means). This battery acts as the electric-power source for supplying electric power to the four fans 60. Further, the electric-power source box 90 is provided with a switch for switching on and off driving operations of the fans 60. In wearing the cooling suit, the electric-power source box 90 is attached to a belt for trousers, for example. Otherwise, the electric-power source box 90 may be accommodated within a dedicated pocket provided on the cloth part 10.

Typically used as the battery is a secondary battery, from an economical standpoint. However, it is most desirable to use a fuel cell as the battery. This is because, fuel cells are small-sized as compared with secondary batteries and never require a charging operation. Further, fuel cells appear to favorably cooperate with the cooling suit. Because of characteristics of fuel cells, fuel cells are not appropriate for a situation required to supply a large amount of electric current at once, but appropriate for a situation for steadily supplying a constant electric current. In case of the cooling suit, steep transient build-up currents are not existent, because the battery is used for driving the above described fans 60.

Relatedly, since fuel cells generate water vapor upon power generation, water vapor generated from a fuel cell may moisten the cloth part 10 in case of adopting the fuel cell as the electric-power source of the cooling suit. It is thus desirable to provide the fuel cell at a position exhibiting higher air-circulation ability inside the cloth part 10. This allows water vapor to be outwardly discharged together with the flowing air-streams, so that the cloth part 10 can be prevented from being moistened by water vapor.

As shown in FIG. 5, provided at predetermined (several) positions at the reverse side of the cloth part 10 are cord fixing means 15 for fixing the connecting cords 69 drawn out of the fans 60, respectively. Used as the cord fixing means 15 are elongated magic tapes each having a size of 1 cm×4 cm, for example. Each magic tape has integrated "A" surface and "B" surface, and has a front end stitched onto the reverse surface of the cloth part 10. Further, each magic tape has a rear end to be adhered to the front end in a manner to catch up the connecting cords 69, thereby allowing fixation of the connecting cords 69.

Figure 2:
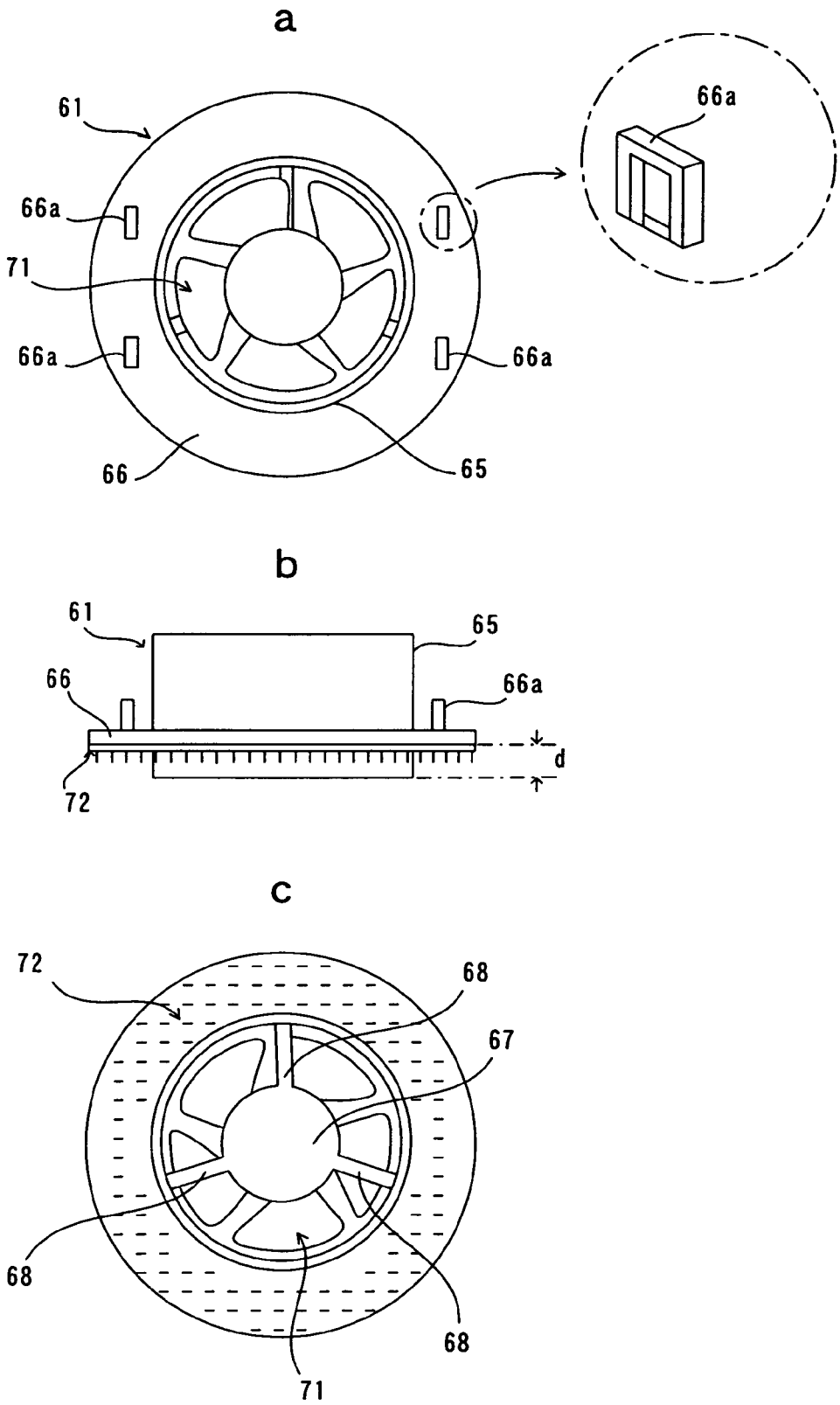
FIG. 2*a* is a schematic plan view of a fan to be used in the cooling suit.
FIG. 2*b* is a schematic side view of the fan.
FIG. 2*c* is a schematic bottom view of the fan.

As shown in FIG. 2, each fan 60 includes a frame part 61, a vane portion 71, a circuit portion (not shown), and a magic tape 72. The frame part 61 comprises a cylindrical member 65, a ring-shaped member 66, a disk-shaped member 67, and three retaining members 68. The ring-shaped member 66 is provided at a predetermined position at an outside surface of the cylindrical member 65. The disk-shaped member 67 is provided inside the cylindrical member 65, and is retained by the three retaining members 68 provided at the inside surface of the cylindrical member 65. Such a frame part 61 is integrally made of plastic by injection molding. Further, the height of the cylindrical member 65 (i.e., the thickness of the fan 60) is about 6 mm.

The vane portion 71 and the circuit portion are disposed inside the cylindrical member 65, and the circuit portion is mounted on the disk-shaped member 67. The circuit portion includes a rotational motor (driving means), and the vane portion 71 is attached to a shaft of the rotational motor. Used as the vane portion 71 is one having a diameter of 10 mm to 100 mm, for example. At this time, the vane portion 71 has its rotational axis, which is substantially parallel to a central axis of the cylindrical member 65 and which is substantially perpendicular to the surface of the ring-shaped member 66. Such a fan 60 is required to have an air discharging ability at a certain level. For example, it is enough for a fan 60 to be able to establish a maximally 50 Pa as an air pressure difference between the interior and the exterior of the cloth part 10 near the fan 60 during driving operation of the fan 60. It is further desirable to adopt a fan having a static pressure of 5 Pa or higher, because the airflow passages includes portions having higher flow resistances in the scheme of this embodiment. Moreover, in the scheme for outwardly discharging air-streams within the airflow passages by the fans, it is desirable to adopt a fan having a static pressure of 150 Pa or lower in order to avoid deformation of the cloth and to prevent the cloth from being closely contacted with the undergarment. Although higher cooling effects are obtained by larger air stream amounts of the fans 60, it is desirable for the total air stream amount of all the fans 60 to be at least 1 liter/sec.

Note that it is preferable to adopt a fan 60 having a weight of 40 g or less, so as to avoid deformation of the cloth part 10 due to the weight of the fan 60. It is further desirable that noises to be generated by the fan 60 are limited to 40 dB[A] or less.

Rotation of the vane portion 71 causes air-streams within the airflow passages to flow toward the vane portion 71 through one opening of the cylindrical member 65, and to be then discharged to the exterior from the other opening of the cylindrical member 65 via vane portion 71. Such a fan 60 has a larger air stream amount relative to its size, and is suitably used for the cooling suit of the first embodiment. But, it is necessary to provide a certain space between: the undergarment; and that end surface of the cylindrical member 65 which opposes to the undergarment; so as to introduce air-streams within the airflow passages into the cylindrical member 65. Generally, the size of the space is determined correspondingly to the diameter of the fan 60.

The magic tape 72 is adhered to the reverse side of the ring-shaped member 66. Such a magic tape 72 is provided to detachably attach the fan 60 to the cloth part 10. Assuming that the magic tape 72 is of "A" surface type, there is provided a magic tape 16 of "B" surface type stitched onto a peripheral portion of the air outlet 50 at the reverse side of the cloth part 10 as shown in FIG. 4. Adhering these two magic tapes 72, 16 to each other causes the fan 60 to be mounted on the peripheral portion of the associated air outlet 50. Thus, upon wearing the cooling suit, the rotational axis of the vane portion 71 becomes substantially perpendicular to the surface of the undergarment. Note that the ring-shaped member 66 acting as a portion to which the magic tape 72 is adhered has a circular shape, because the magic tape 16 paired with the magic tape 72 is to have a mounting surface area as small as possible when the magic tape 16 is mounted on the cloth part 10.

Meanwhile, in detaching the fans 60 from the cooling suit, the magic tapes acting as the cord fixing means 15 are firstly separated in themselves to terminate the fixed states of the connecting cords 69, respectively. Next, the magic tapes 72 of the fans 60 are separated from the associated magic tapes, respectively, thereby detaching the four fans 60 from the cooling suit. In this way, anyone is allowed to readily detach the fans 60. Note that it is possible to attach and detach the fans 60 by sheet-like magnets, instead of magic tapes 72. In this way, constituting the fans 60 and electric-power source box 90 in the detachable manner provides advantages that not only the cooling suit can be readily washed, but also the fan(s) 60 can be independently exchanged upon malfunction thereof.

Further, each fan 60 is designed such that the fan 60 is not outwardly protruded beyond the mesh-like material 51 of the associated air outlet 50 when the fan 60 is mounted on the peripheral portion of the air outlet 50. Namely, as shown in FIG. 2*b*, the fan 60 is designed to have a distance d between the end surface of the cylindrical member 65 and the ring-shaped member 66 at the reverse surface side of the fan 60 such that the distance d is a sum of the thickness of the magic tape 72 and the thickness of the magic tape provided at the associated air outlet 50. This, as shown in FIG. 4, results in that the end surface of the fan 60 is substantially flush with an obverse surface of the cloth part 10 when the fan 60 is mounted on the cloth part 10. Thus, the fan 60 is not obstructive to the wearer of the cooling suit upon working, and also the incongruent feeling in the external appearance of the cooling suit is reduced. Note that it is typically desirable to mount the fan 60 such that the end surface of the fan 60 is not outwardly protruded from the obverse surface of the cloth part 10 by 5 mm or more.

Driving the fan 60 usually rotates its vane portion 71 at a constant revolution number. This causes the fan 60 to feed out a constant amount of air stream. Without limited thereto, it is possible for the fan 60 to conduct so-called "fluctuated air-blowing" to feed out the air-stream in a manner that the air stream amount is variably adjusted or the air stream amount is variably strengthened and weakened, for example. In that case, since electric power is wasted when variable resistances or the like are used to change the revolution number of the vane portion 71, it is desirable to adopt a modulating method such as PWM (pulse width modulation) or to change the voltage by a DC-DC converter. It is further possible to provide a temperature sensor or temperature/humidity sensor inside the cooling suit, and to control the revolution number of the vane portion 71 based on the temperature or temperature/humidity sensed by such a sensor.

Note that since the fan 60 may be wetted in case of sudden rain during outdoor working, it is desirable to apply a waterproof treatment to the circuit portion of the fan 60 as a countermeasure thereto. Concretely, it is conceivable to coat a resin onto the circuit portion as such a waterproof treatment.

The clearance holding means 80 is to hold a predetermined clearance between the associated fan 60 and the undergarment. Creases are inevitably caused in the undergarment when the wearer of the cooling suit is working or conducting other movements. Such creases narrow the clearance between the upper end of the fan 60 (that end of the fan 60 which opposes to the undergarment) and the undergarment, thereby making it difficult for the air-stream to flow into the fan 60. Even in such a state, the clearance holding means 80 serves to restrict the creases of the undergarment, thereby holding air-streams.

As shown in FIG. 3*a*, each clearance holding means 80 has a main body portion 81 and four leg portions 82. This clearance holding means 80 has a thickness of about 0.3 mm. Used as the material of the clearance holding means 80 is a plastic sheet or the like which is soft and has elasticity. The main body portion 81 has a substantially circular outer shape, and has a plurality of openings formed therein. In the example of FIG. 3*a*, the main body portion 81 has four sectorial openings formed therein so that the main body portion 81 has a ring-like portion and two straight portions positioned to be mutually crossed inside the ring-like portion. Note that the openings are required to be sized to such an extent that creased portions of the undergarment never enter the openings.

As shown in FIG. 3*b*, each leg portion 82 has a tip end portion having a cut-out 82*a* formed therein in an elongated manner in the longitudinal direction, and having two short widthwise cut-outs 82*b* formed therein. The former cut-out 82*a* is provided to narrow the width of the associated leg portion 82, and the latter cut-outs 82*b* are provided to fix the associated leg portion 82. Further, as shown in FIG. 2, formed in the ring-shaped member 66 of the associated fan 60 are four attaching portions 66*a* for attaching the associated clearance holding means 80 to the fan. Such attaching portions 66*a* are formed to protrude from the surface of the ring-shaped member 66. Further, each attaching portion 66*a* has a hole formed therein, for inserting the associated leg portion 82 thereinto.

To attach the clearance holding means 80 to the associated fan 60, the main body portion 81 is firstly positioned to oppose to the fan 60, and one leg portion 82 is narrowed in its width by gripping its tip end portion by hand. Then, the tip end portion of the leg portion 82 is directly pushed into the associated attaching portion 66*a*. This causes the two cut-outs 82*b* of the leg portion 82 to be engaged with the associated attaching portion 66*a*, thereby fixing the leg portion 82. Similarly, also the remaining three leg portions 82 are fixed to the associated attaching portions 66*a*, respectively. In this way, the clearance holding means 80 is mounted to cover that surface of the associated fan 60 which opposes to the undergarment as shown in FIG. 4. Provision of the clearance holding means 80 allows the main body portion 81 of the clearance holding means 80 to block or repel the creased portions of the undergarment, if any, thereby allowing a certain clearance to be constantly held between the undergarment and the associated fan 60.

Further, even when the clearance holding means 80 is pressed from the exterior, it can be readily moved in the pressed direction because it has elasticity. Thus, the wearer will never feel that the clearance holding means 80 is rigid while the clearance holding means 80 is abutted on the undergarment. Moreover, the clearance holding means 80 is readily collapsed when pressed, and is capable of immediately reverting to its original state upon released from the pressing force. Actually, it is enough to use one having an extremely weak elasticity as the clearance holding means 80.

For example, when the wearer wearing the cooling suit sits in/on a chair and the back portion of the cooling suit is pressed by a backrest of the chair, the clearance holding means 80 is collapsed and its main body portion 81 contacts with the upper end of the associated fan 60. In this way, the clearance holding means 80 can be collapsed by virtue of its elasticity, so that the clearance holding means 80 never gives rugged feeling to the wearer. But, air-streams are not allowed to flow into the applicable fan 60 in a state where the main body portion 81 of the associated clearance holding means 80 is contacted with the upper end of the fan 60, so that the cooling effect at the back portion of the wearer is not so effective then.

In addition to the role for preventing the creased portions of the undergarment from obstructing air-streams, the clearance holding means 80 also serves as a spacer for being contacted with the undergarment and ensuring an airflow passage near the associated fan 60. In order for the clearance holding means 80 to serve as the spacer when the associated fan 60 is in a practical size, it is necessary to take a distance of at least 2 mm between the main body portion 81 of the clearance holding means 80 and the upper end of the fan 60 opposing thereto. Distances less than 2 mm increase the resistance against the flowing air-streams and thus reduce the air stream amount.

Figure 8:
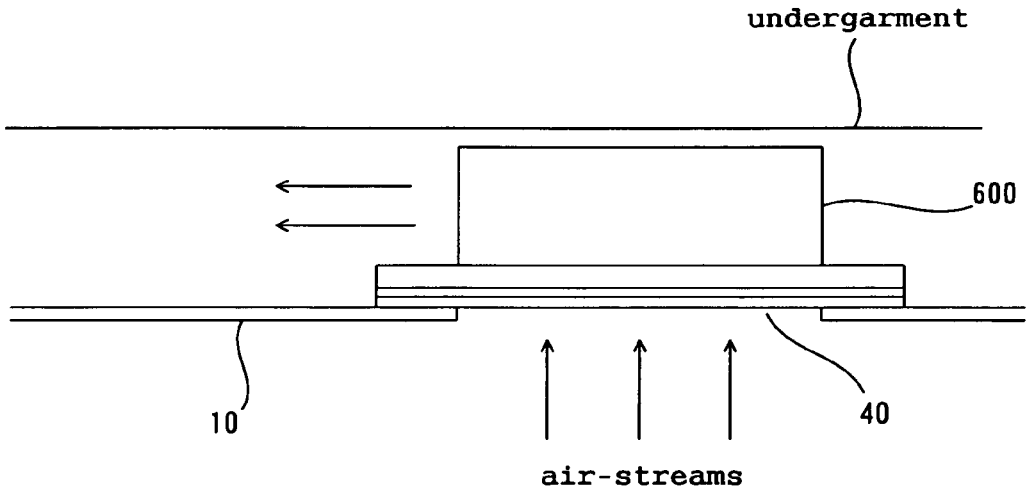
FIG. 8 is a schematic view of a sideward-flow fan attached to an air inlet.

Note that it is possible to adopt a sideward-flow fan as represented by a sirocco fan, instead of the above-mentioned fan 60, in the cooling suit of the first embodiment. The term "sideward-flow fan" means a fan, which sucks air in an axial direction of vanes and radially feeds out the air into the outer peripheral direction of the vanes. In adopting the sideward-flow fan in the cooling suit, the air inlet is provided at the lower portion of the cloth part and the air outlet is provided at the upper portion of the cloth part, and the sideward-flow fan is attached to the reverse side of the cloth part 10 at a position corresponding to the air inlet. FIG. 8 is a schematic view of the sideward-flow fan attached to the air inlet. As shown in FIG. 8, air-streams sucked by a sideward-flow fan 600 through its air inlet 40 are radially fed out from the side surface of the sideward-flow fan 600 into the airflow passages, then passed through the airflow passages, and finally discharged to the exterior through the air outlet. Particularly, it is possible to absolutely define a space between the cloth and the undergarment around the sideward-flow fan 600 to thereby allow reduction of air resistance, by adopting one having a certain thickness as the sideward-flow fan 600. Further, adoption of the sideward-flow fan provides a merit that air-streams are readily flowed even when the air resistance of airflow passages is high, because the sideward-flow fan provides a higher pressure.

There will be explained hereinafter a material of the cloth part 10. Used as the material of the cloth part 10 is a high-density cloth such as used as an outer material of a down jacket, for example. High-density cloths are woven at higher densities as compared with normal cloths. As described later, since the cooling suit of the first embodiment is to cause the humidified air-streams warmed by the wearer's body to be flowed within the airflow passages and to be discharged from the air outlets 50 to thereby steadily substitute such air-streams by fresh outside air, it is necessary to prevent the air-streams from leaking through the cloth part 10 during flowing of the air-streams through the airflow passages. Since the high-density cloth has a higher density of threads, the amount of air-streams leaking between the threads to the exterior is extremely small, and most of the air-streams pass through the airflow passages up to the air outlets 50 and are discharged therefrom to the exterior. Thus, the high-density cloth is desirably used as the material of the cloth part 10. The high-density cloth has such an advantage that it can be readily washed by a household washer when it is contaminated, since the high-density cloth strictly is a cloth. Such high-density cloths are manufactured for various purposes, and inexpensively available. Note that the high-density cloth is to preferably have a lower air-permeability, and concretely, it is necessary to adopt such a high-density cloth that the air volume passing or permeating through the high-density cloth per unit time and per unit surface area is 5 $cc/cm^2/sec$ or less in case of applying a pressure of 5 Pa to the high-density cloth.

Usable as the material of the cloth part 10 is not only the high-density cloth, but also any materials insofar as capable of substantially preventing leakage of air. Particularly, in case of using the cooling suit upon conducting a work accompanied by contamination, to be desirably adopted as the material of the cloth part 10 is a material without water absorptivity or a material having a water repellent treatment applied thereto, such as vinyl or nylon material having a smooth surface. This is because, the contamination adhered to the cloth part 10 can be then readily removed therefrom. Should a material having water absorptivity be adopted for the cloth part 10, air-streams flowing in the airflow passages are consumed for evaporating the water content absorbed into the cloth part 10 such as when the cloth part 10 is wetted by rain, for example, so that perspiration from the wearer's body is not effectively evaporated. Adoption of the above-mentioned material prevents contamination from permeating into the cloth part 10, and the contamination can be readily removed therefrom. On the other hand, should a material having water absorptivity be adopted for the cloth part, the cloth part is wetted when it contacts with the undergarment wetted by perspiration, so that the undergarment and the cloth part are hardly separated from each other even if the wearer's body is moved. Moreover, even when they are separated and air-streams are allowed to flow therefrom, evaporation of perspiration at the cloth side has a less effect for cooling the wearer's body. Contrary, although the recommended material without water absorptivity has lower air permeability and is incapable of diffusing moisture inside the cooling suit to the exterior through the material itself, this is not a problem because the moisture passes through the airflow passages together with the air-streams and then discharged to the exterior by virtue of the fans 60. Note that it is desirable to apply a heat ray reflecting treatment to the surface of the cloth part 10 when the cooling suit is worn mainly upon working outdoors.

Incidentally, since the lower end of the cooling suit is opened so that air-streams flowing between the cloth part 10 and the undergarment may leak from such the lower end of the cloth part 10, it is necessary then to provide air-leakage preventing means for the cooling suit. For example, it is preferable to insert a rubber string through the bottom portion of the cooling suit, and to tighten the bottom portion by the rubber string, thereby causing the bottom portion of the cooling suit to closely contact with a periphery of the waist of the wearer. It is also possible to cause the bottom portion of the cooling suit to contact with the periphery of the waist of the wearer, by a string or belt. Note that it is further possible to fabricate such a cooling suit that the fans are provided near the central portion of the cloth part, and air inlets are provided not only at the upper portion but also at the lower portion of the cloth part. Also in this situation, the above-mentioned air-leakage preventing means is required.

Further, in fabricating such a cooling suit, it is desirable to previously manufacture the fans 60 and electric-power source box 90 as separate parts, respectively. This allows the cooling suit to be readily fabricated, even when the same is applied to garments other than work suits.

Figure 6:
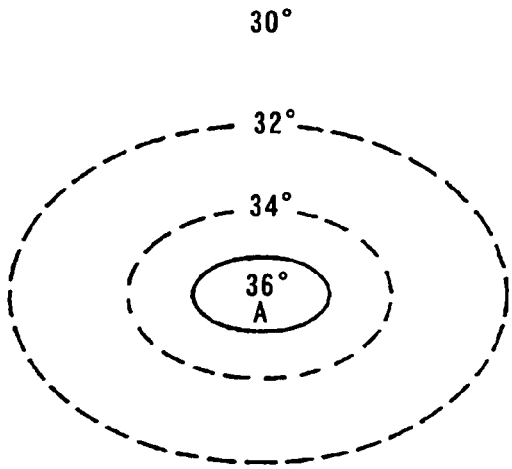
FIG. 6 is a view explaining a cooling principle utilized in the cooling suit of the first embodiment.
Figure 6:
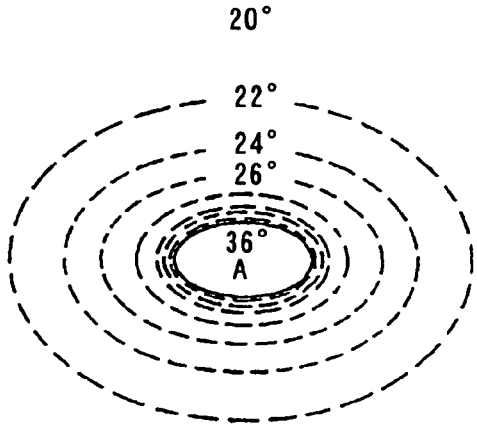
Figure 6:
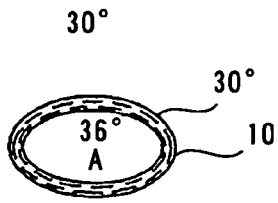

There will be described hereinafter the cooling principle to be utilized in the cooling suit of the first embodiment. FIG. 6 is a view explaining a cooling effect utilized in the cooling suit of the first embodiment. Schematically shown by isotherm lines (dotted lines) in FIG. 6*a* is a temperature distribution around a wearer A when the wearer A is in a room at a temperature of 30° C. As shown in FIG. 6*a*, assuming that the body temperature of a wearer A as a homoiothermal animal is constant at 36° C. and that the air in the room is not largely convected, the temperature is the highest near the wearer A and is gradually lowered and approaches down to 30° C. in the direction from the wearer A.

Schematically shown by isotherm lines in FIG. 6*b* is a temperature distribution around a wearer A when the wearer A is in a room at a temperature of 20° C. As understood by comparing FIG. 6*b* with FIG. 6*a*, the intervals among isotherm lines in FIG. 6*b* are denser than those in FIG. 6*a*. In other words, the temperature gradient in FIG. 6*b* is steeper than that in FIG. 6*a*. The magnitude of temperature gradient determines the heat amount to be dissipated from the wearer, and largely affects the temperature feeling of the wearer. Namely, the steeper the temperature gradient, the more strongly the wearer feels hotness and coldness.

In view of this fact, the temperature gradient just near the surface of the wearer's body is forcibly increased in the first embodiment, thereby rendering the wearer to feel coolness and comfortableness. FIG. 6*c* shows a temperature distribution where the wearer A is wearing the cooling suit of the first embodiment in a room at a temperature of 30° C. Although the room temperature in FIG. 6*c* is the same as that in FIG. 6*a*, the wearer A is wearing the cooling suit, and air-streams at 30° C. identical with the room temperature are continuously flowed into the airflow passages of the cooling suit, to thereby locate the isotherm line of 30° C. at a position only slightly separated from the body of the wearer A. This extremely increases the temperature gradient from the body surface of the wearer A toward the surroundings, so that this situation resembles that of FIG. 6*b* considering the temperature gradient only between the wearer A and the cooling suit.

Thus, by wearing the cooling suit of the first embodiment and by flowing air-streams within the airflow passages to thereby bring the temperature at the portion relatively near the wearer's body surface to a temperature lower than the body temperature, there can be realized a steeper temperature gradient near the wearer's body surface. This steeper temperature gradient causes the heat dissipated from the wearer's body surface: to be readily radiated to the cooling suit side at the lower temperature; and to be quickly absorbed by air-streams flowing within the airflow passages. Thus, only flowing air-streams within the airflow passages by the fans 60 allows a wearer to feel coolness in the cooling suit of the first embodiment.

As described above, the steeper temperature gradient near the wearer's body surface leads to a larger cooling effect. This is also true for humidity. Namely, the humidity is about 100% near the wearer's body surface, in a hot condition. At this time, when a layer having the humidity of the outside air is formed near the wearer's body surface, it becomes possible to realize a steeper humidity gradient near the wearer's body surface. Such a steeper humidity gradient promotes evaporation of perspiration to thereby allow the wearer to feel coolness.

The cooling suit of the first embodiment causes air-streams to flow through the airflow passages which are spaces between the cloth part 10 and the undergarment. In a situation where the wearer has perspired but the perspiration has not been so absorbed into the undergarment, the perspiration permeates through the undergarment into the space between the cloth part 10 and the undergarment, because the undergarment allows water vapor to permeate therethrough. This water vapor is readily carried out to the exterior by the air-streams flowing in the airflow passages, thereby directly cooling the wearer's body by the absorption of an evaporation heat from the wearer's body by the perspiratory effect. Namely, by contacting the perspiration from the wearer's body with the air-streams flowing within the airflow passages, the perspiration from the wearer's body is evaporated, to thereby utilize an effect to take away an evaporation heat from the surroundings upon evaporation of the perspiration, thereby cooling the wearer's body.

Further, in a situation where the wearer has perspired so much and most of the perspiration has been absorbed by the undergarment, the perspiration absorbed by the undergarment is carried to the exterior by the air-streams flowing within the airflow passages, thereby extremely increasing the evaporation amount of the perspiration. This drastically lowers the surface temperature of the undergarment. For example, when the room temperature is 30° C. and the air at the same temperature as the room temperature is sufficiently flowed near the wet undergarment surface, the surface temperature of the undergarment is brought to a value lower than the room temperature by 3° C. to 5° C. Particularly, when the undergarment is closely contacted with the wearer's body, there exists a moisture content between the wearer's body and the undergarment, and the heat resistance of a wet undergarment is extremely small as compared with the heat resistance of a dried undergarment, thereby causing a large temperature difference near the wearer's body surface so that the wearer feels coolness. Thus, based on the automatic body-temperature adjusting function to be inherently possessed by human beings, the wearer perspires less and is allowed to feel sufficient coolness.

In this way, in a situation where the wearer has perspired, the cooling suit is capable of increasing the temperature gradient as well as the humidity gradient near the wearer's body surface, thereby allowing the wearer to feel more coolness and comfortableness.

Figure 7:
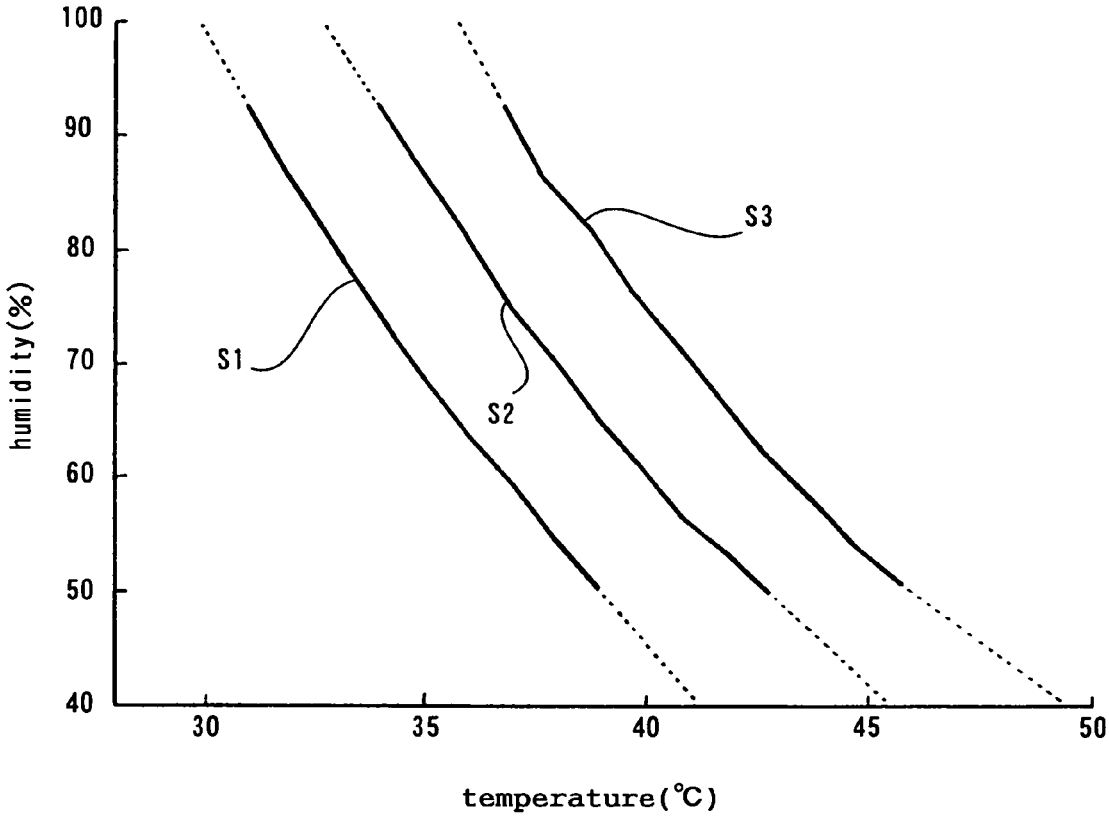
FIG. 7 is a graph explaining an environment where a cooling effect is obtainable by virtue of the cooling suit.

There will be explained hereinafter an environment where a cooling effect is obtainable by virtue of the cooling suit of the first embodiment. FIG. 7 is a graph explaining an environment where a cooling effect is obtainable by virtue of the cooling suit. FIG. 7 shows an ordinate representing humidity and an abscissa representing temperature. Left side reference character S1 designates a curve where a wet-bulb temperature is 30° C., intermediate reference character S2 designates a curve where a wet-bulb temperature is 33° C., and right side reference character S3 designates a curve where a wet-bulb temperature is 36° C. Note that such a graph was obtained in the environment of a sufficient air stream amount, and the results therefrom are schematically shown here.

As understood from the above-mentioned cooling principle, the cooling effect of the cooling suit is not obtained even when the cooling suit is used, in an environment that the perspiration from the wearer's body is not allowed to evaporate. Thus, as shown in FIG. 7, it is theoretically considered that the cooling effect by the cooling suit is substantially absent in an environment corresponding to a right region delimited by the right curve S3. Also, the cooling effect by the cooling suit is not expected so much in an environment corresponding to a region surrounded by the right curve S3 and the intermediate curve S2, since the perspiration from the wearer's body is not allowed to evaporate so much. Meanwhile, the cooling effect by the cooling suit is obtainable in an environment corresponding to a region surrounded by the intermediate curve S2 and the left curve S1, since the perspiration from the wearer's body is allowed to evaporate then. Further, the cooling effect by the cooling suit is considered to be sufficiently obtainable in an environment corresponding to a left region delimited by the left curve S1, since the perspiration from the wearer's body is allowed to evaporate sufficiently. The left side environment delimited by the intermediate curve S2 and spreading over the curve S1 corresponds to a normal life environment of wearers. It is thus theoretically considered that the cooling effect can be obtained by using the cooling suit when it is used in any environments, except for impractical environments.

According to the cooling suit of the first embodiment, air-streams can be flowed substantially parallelly to the wearer's body surface between the cloth part and the wearer's body by forcibly causing the air-streams in the airflow passages by the fans, thereby enabling steeper temperature gradients near the wearer's body surface. Thus, simply wearing such a cooling suit enables the wearer to feel coolness and comfortableness. Further, in a perspiring situation, the perspiration can be carried out to the exterior by the air-streams flowing within the airflow passages, so as to directly cool the wearer's body by the absorption of an evaporation heat by the perspiratory effect, thereby resulting in a further improved cooling effect.

Particularly, the provision of the air-leakage preventing means makes it possible to assuredly prevent the air-streams flowing between the cloth part and the undergarment from outwardly leaking from the lower end of the cloth part, so that the cooling effect is never deteriorated due to such air leakage.

Further, since the cooling suit of the first embodiment includes the clearance holding means provided to cover that side surface of the associated fan which opposes to the undergarment, the airflow passages can be held between the fan and the undergarment, and the upper end of the fan can be prevented from being clogged by creased portions of the undergarment, thereby making it possible to assuredly avoid occurrence of a situation where the cooling effect is deteriorated.

Although there has been described a situation where the cooling suit is worn on the undergarment in the first embodiment, it is possible to directly wear the cooling suit onto a naked skin, for example.

Although there has been described a situation where the front portion of the cooling suit is opened and closed by the fastener in the first embodiment, it is possible to exemplarily open and close the front portion of the cooling suit by a magic tape. Further, such a cooling suit can be applied to a garment of a type having a rear portion to be opened and closed by a fastener or the like, or to a garment of a type which has closed front and rear portions and which is thus worn by passing a head of the wearer through the garment.

Figure 9:
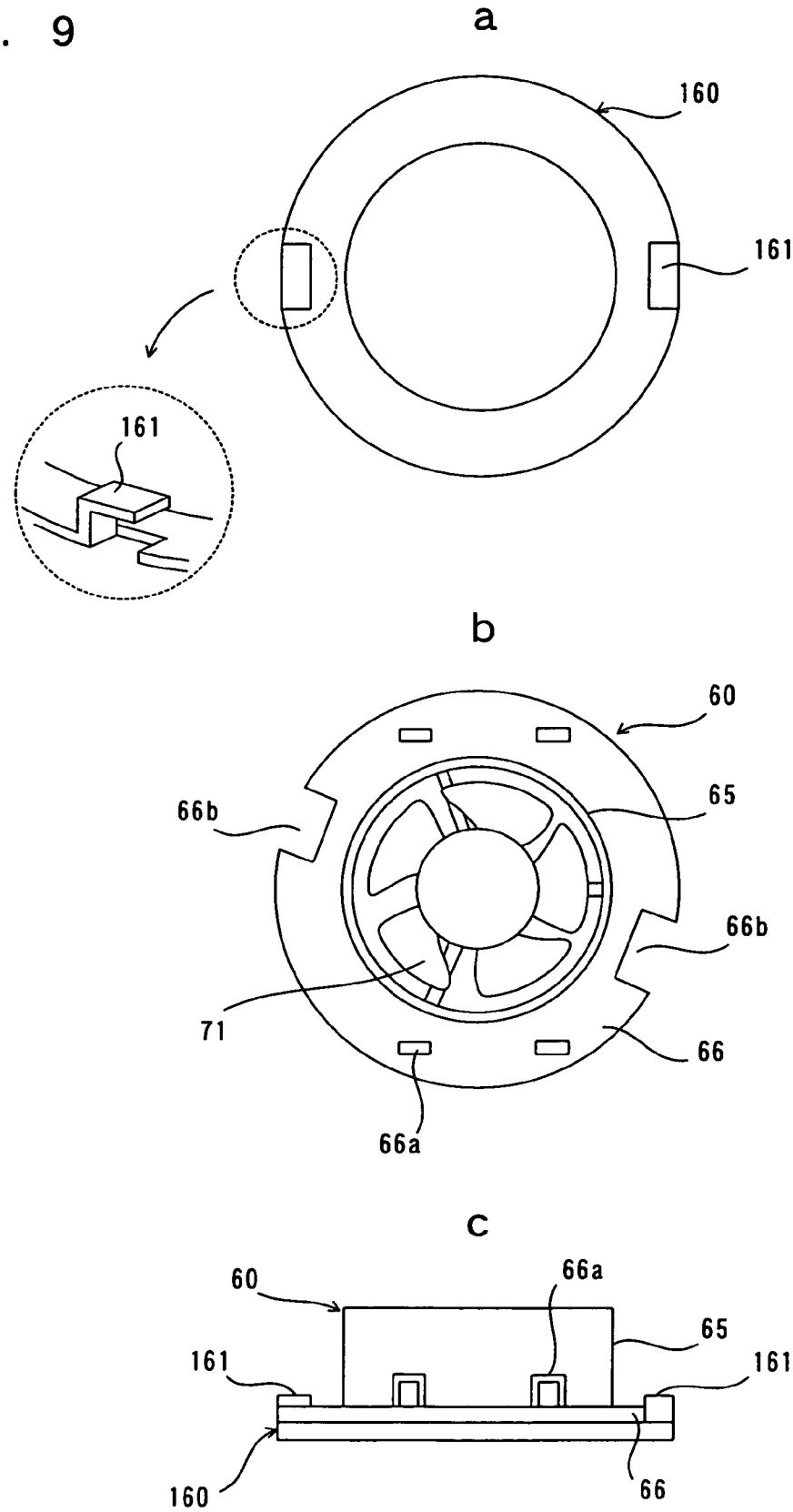
FIG. 9 is a view explaining another example of an attaching method of the fan.

In the first embodiment, there has been explained a situation where the fans are detachably attached to the cloth part by the magic tapes. However, it is possible to detachably attach the fans to the cloth part, by the following manner. FIG. 9 is a view explaining another example of an attaching method of the fan. This method uses a fan-retaining member (retaining means) 160 shown in FIG. 9*a*, which is stitched to a peripheral portion of an air outlet at the reverse side of the cloth part. This fan-retaining member 160 has a substantially annular shape, and its inner circle has a diameter which is substantially the same as that of the cylindrical member 65 of the associated fan 60. Further, the fan-retaining member 160 has two engaging pawls 161 formed thereon. Meanwhile, used as the fan 60 is one which is substantially the same as that shown in FIG. 2 and which is different therefrom in the following two points. Namely, the first difference resides in absence of magic tapes for the fan 60, and the second difference resides in formation of two cutouts 66*b* in the ring-shaped member 66 of the fan 60, as shown in FIG. 9*b*. Firstly, the fan 60 is abutted on the fan-retaining member 160 by aligning the cutouts 66*b* of the fan 60 with the engaging pawls 161 of the fan-retaining member 160, respectively. Thereafter, the fan 60 is turned about the central axis of the vane portion 71, so that those portions of the ring-shaped member 66 which are positioned near the cutouts 66*b*, are engaged with the engaging pawls 161, respectively. In this way, the fan 60 is mounted on the fan-retaining member 160 as shown in FIG. 9*c*. Note that the fan-retaining member 160 may be adhered to the cloth part, instead of stitching the former onto the latter.

Although the first embodiment has been described about the situation where the cooling suit is provided with four fans, the number of fans is not specifically limited and it is possible to provide one, two, three, five or more fans.

Similarly, the numbers of air inlets and air outlets are not limited. It is possible to provide one, two, four or more air inlets and to provide one, two, three, five or more air outlets.

Further, although the first embodiment has been described about the situation where the four fans are supplied with electric power from one electric-power source box, it is possible to establish the inside of the cooling suit in a cordless manner by independently mounting an electric-power source and a controlling circuit to each fan, for example. Provision of the fans in the cordless manner makes it possible to readily conduct an exchanging operation of secondary batteries by simply attaching/detaching the fans while wearing the cooling suit, for example. In this case, it is further possible to provide the fans with receiving circuits, respectively, and to turn on/off the fans and/or change over the powers of the fans by wirelessly transmitting signals from external transmitting means to the receiving circuits. It is desirable here to adopt, as the transmitting means, those having sizes and shapes such as a fountain-pen shape, which can be put into a pocket. Further, the transmitting function may be built in a cellular phone. It is desirable for the receiving circuit to have at least 1,000 pieces of unique communications identification codes, so as to avoid cross talk. On the other hand, in case that the electric-power source means is commonly used for all the fans, the electric-power source means may be provided with a controlling circuit, a receiving circuit, and a communications-identification-code decoding circuit. Moreover, the electric power to be supplied to the fans may be extracted from commercial power supply, in case that the wearer of the cooling suit works at a fixed work area or the like without moving there around, for example. Alternatively, the cooling suit may be used, while charging the secondary batteries by commercial power supply. Note that the above-described controlling circuit is to controllingly turn on/off the fans and to control the revolution numbers of the respective vane portions. Although the controlling circuit is to control a driving operation of each fan, for example, it is possible that the four fans are divided into a plurality of groups such that the driving operations of fans are controlled for each group.

As a part of the undergarment in the first embodiment, it is desirable to use such an elastic material made of polyurethane, called spandex, for example. This causes the undergarment to closely contact with the wearer's body, thereby allowing prevention of degradation of the cooling effect. In this case, it is desirable to use a water absorbing material as the undergarment.

There will be explained hereinafter a second embodiment of the present invention, with reference to the drawings. FIG. 10*a* is a schematic front view of a cooling suit according to the second embodiment of the present invention, and FIG. 10*b* is a schematic rear view of the cooling suit. Like reference numerals as used in the first embodiment are used in the second embodiment to denote those elements having the same functions as the first embodiment, and the detailed description thereof shall be omitted.

Figure 10:
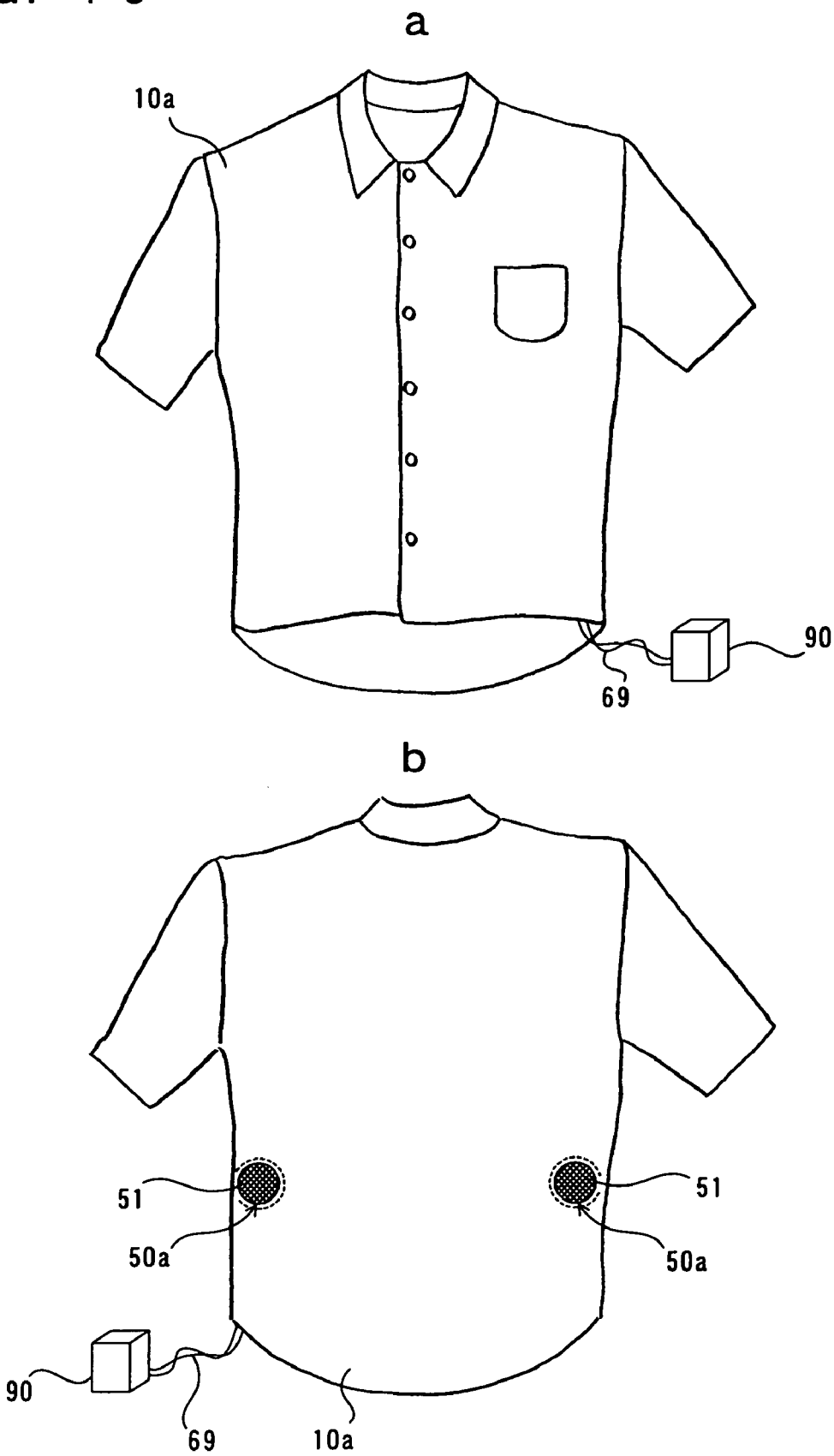
FIG. 10*a* is a schematic front view of a cooling suit according to a second embodiment of the present invention.
FIG. 10*b* is a schematic rear view of the cooling suit.

As shown in FIG. 10, the cooling suit of the second embodiment comprises: a cloth part 10*a*; two air outlets (air-flow openings) 50*a*; two fans (air-blowing means) 60; two pieces of clearance holding means 80; an electric-power source box 90; and air-leakage preventing means (not shown). The second embodiment will be described hereinafter concerning a situation that such a cooling suit is applied to clothes such as dress shirt and the like of a type where the clothes are worn by inserting the bottom portion thereof into trousers or skirt. It is thus necessary for the bottom portion of the cloth part 10*a* to have a certainly extended length. In this case, the air-leakage preventing means is correspondingly provided by the constitution that the bottom portion of the cloth part 10*a* is inserted into trousers or the like. Further, the cooling suit is to be of a short-sleeved type having its front portion closed by buttons. This cooling suit is to be worn on an undergarment.

In the second embodiment, since the cooling suit is applied to a dress shirt, the buttons are used as means for closing the front portion thereof. In case of using the buttons, the air-streams may be leaked to the exterior through gaps between vertically neighboring buttons. To prevent such air leakage, it is conceivable to increase a lateral width of the front closing portion of the dress shirt, for example. It is also conceivable to increase the number of buttons, thereby narrowing distances between the buttons, respectively. It is further possible to mount a magic tape or fastener on the front closing portion of the dress shirt, and to provide decorative buttons thereon, thereby simulating an external appearance of dress shirt.

The two air outlets 50*a* are formed at those predetermined positions of the cloth part 10*a*, which correspond to the lower end portion of the back portion of the cloth part. Concretely, the two air outlet 50*a* are formed at those positions, which are slightly shifted from the right and left flank portions to the back portion of the cloth part 10*a*, at the lower portion of the cloth part 10*a*, respectively. Such air outlets 50*a* are formed by exemplarily cutting out predetermined portions of the cloth part 10*a* and by stitching mesh-like materials 51 onto the cut out portions from the reverse surface side of the cloth part 10*a*, respectively.

The two fans 60 are provided to forcibly cause flow of air-streams within the airflow passages, and mounted at those positions on the reverse surface of the cloth part 10*a* which correspond to the air outlets 50*a*, respectively. In the second embodiment, since the two fans 60 are mounted at positions slightly shifted from the right and left flank portions to the back portion of the cloth part 10*a*, the fans 60 are not obstructive and not collided with inadvertently moved arms of the wearer of the cooling suit. Further, the electric-power source box 90 is an electric-power source for supplying electric power to the two fans 60. Note that the structures of the fans 60 and electric-power source box 90 are substantially the same as those in the first embodiment.

Further, the clearance holding means 80 is to hold a predetermined clearance between the associated fan 60 and the undergarment, and the structure and function of this means are substantially the same as those in the first embodiment.

There will be explained hereinafter a material of the cloth part 10*a*. In the second embodiment, different materials are used for the upper portion and other portions of the cloth part 10*a*, respectively. Namely, used for the upper portion of the cloth part 10*a* is a highly air-permeable material, and used for the other portions of the cloth part 10*a* is a material for substantially preventing air leakage, identically to the first embodiment. It is thus possible for the outside air to flow into the airflow passages, by permeating through the upper portion of the cloth part 10*a*. Unlike the first embodiment, air inlets are not formed by cutting out portions of the cloth part in the second embodiment. Instead, the upper portion of the cloth part 10*a* serves as air inlets. Herein, there shall be used a term "air-permeating region" for such a region serving as the air inlets in this way, which is the upper portion of the cloth part 10*a* and for which the highly air-permeable material is used. In the second embodiment, the air-permeating region extends from the shoulder of the cloth part 10*a* to a position thereof that is about 5 cm lower than the shoulder, for example. It is further desirable to apply a water repellent treatment to the air-permeating region. Without such a treatment, the air-permeability of the air-permeating region will be considerably deteriorated when the region is wetted by water.

Concerning the highly air-permeable material to be used for the air-permeating region, it is desirable to refrain from using one that exhibits a recognizable difference at a glance between the air-permeating region and the other portions in the cloth part 10*a*. This is to reduce an incongruent feeling in the external appearance of the cooling suit. As the material for the air-permeating region, it is inappropriate to use an excessively coarse mesh-like material by which the undergarment becomes excessively see-through, for example. However, it is possible to use a material that is finely woven to a certain degree. Thus, the outside air is to receive a certain resistance from the material used as the air-permeating region, upon flowing into the airflow passages through the air-permeating region. It is thus desirable to provide an increased surface area of the air-permeating region, so as to introduce a sufficient amount of air into the airflow passages.

There will be explained hereinafter air-permeability demanded for such a cloth part 10*a*.

As a quantitative physical value representing the air-permeability of the cloth part 10*a*, there is now considered a volume of air ($cc/cm^2/sec$) which passes or permeates through the cloth part 10*a* per unit time and per unit surface area of the cloth part 10*a* when a pressure of 5 Pa (about 0.5 mm $H_2O$) is applied to the cloth part 10*a*. To obtain an excellent cooling effect upon wearing the cooling suit, it is necessary to allow introduction of a sufficient amount of air at the air-permeating region of the cloth part 10*a* which serves as the air inlets. Contrary, it is necessary that air is rarely leaked at portions other than the air-permeating region of the cloth part 10*a*, such as those near the fans 60, for example. As a result of experiments by the present inventors, it has been found that sufficient cooling effects are obtainable by using such a cloth part 10*a* that the air amount passing through the cloth part 10*a* corresponding to the air-permeating region is at least 2 $cc/cm^2/sec$, and the air amount passing through the cloth part 10*a* corresponding to portions other than the air-permeating region is at most 1 $cc/cm^2/sec$.

While the absolute values of the permeability are different depending on pressures of fans to be used, air resistances of the airflow passages and the like, it is generally desirable that the air amount passing through the cloth part 10*a* corresponding to the air-permeating region is three or more times larger than the air amount passing through the cloth part 10*a* corresponding to portions other than the air-permeating region.

Note that it is also possible to attach a backing cloth to the cloth part 10*a*, thereby preventing the air-streams flowing within the airflow passages from leaking to the exterior through portions of the cloth part 10*a* other than the upper portion of the cloth part 10*a*. For example, there is used a highly air-permeable material for that region of the backing cloth which corresponds to the upper portion of the cloth part 10*a*, and there is used a substantially air-impermeable material for that region of the backing cloth which corresponds to portions of the cloth part 10*a* other than its upper portion. In turn, there is used a highly air-permeable material for all regions of the cloth part 10*a*. This makes it possible to introduce a sufficient amount of air through the upper portion (air-permeating region) of the cloth part 10*a* into the airflow passages, while causing air-streams to be rarely leaked to the exterior through portions of the cloth part 10*a* other than the upper portion thereof. In this way, the amounts of the air-streams flowing into and out through the cloth part 10*a* are controlled by the backing cloth, thereby advantageously making it possible to use the same cloth for the whole of the cloth part 10*a* and to improve the external appearance of the cloth part 10*a*, while restricting the manufacturing cost of the cooling suit because the air-permeability can be controlled by the backing cloth in a more inexpensive manner than by the cloth part 10*a*.

Here, it is possible to exemplarily use the following method for fabricating the backing cloth having such two properties. Namely, there is firstly prepared a highly air-permeable material as a whole. Then, that region of the material, which corresponds to the region of the cloth part 10*a* other than the upper portion of the cloth part 10*a*, is laminated with a substantially air-impermeable material such as plastic film, for example. It is particularly desirable to use a film having a higher moisture permeability at a region where air movement is less, such as that region of the cloth part 10*a* which corresponds to the vicinity of a belt for trousers, for example. This makes it possible to substantially prevent air-streams from leaking through the regions laminated with the plastic film or the like. Adoption of such a method allows the backing cloth to be fabricated readily and inexpensively. Note that this method is also applicable to a situation where the air-permeability is controlled by the cloth part 10*a*.

The cooling suit of the second embodiment exhibits the same functions and effects as the first embodiment. Particularly, in the cooling suit of the second embodiment, air is introduced into the airflow passages by utilizing the material of the cloth part while providing the two air outlets at the positions slightly shifted from the right and left flank portions to the back portion, so that the cooling suit perfectly looks like a normal dress shirt when viewed from the front of the cooling suit because the fans are invisible then. The cooling suit is different from a normal dress shirt concerning an external appearance, only in that the two air outlets are provided at those positions of the cloth part which are slightly shifted from the right and left flank portions to the back portion. Thus, incongruent feeling in the external appearance is substantially absent, even upon wearing the cooling suit. Further, since the two fans in the second embodiment are not provided at the center of the back portion but at those positions which are slightly shifted from the right and left flank portions to the back portion of the cloth part, respectively, the air discharging openings of the fans are not closed even when the wearer of the cooling suit sits in/on a chair.

Further, the cooling suit of the second embodiment is different from a normal dress shirt only in the provision of the two air outlets, when the two fans and the electric-power source box are detached from the cooling suit. Thus, the cooling suit can be washed in the state where the fans and electric-power source box are detached, when the cooling suit is contaminated.

It is additionally possible to inexpensively manufacture the main body of the cooling suit from which the fans and electric-power source box are detached. Thus, the wearer of the cooling suit is allowed to wear each dress shirt as a cooling suit everyday, by purchasing a plurality of main bodies of cooling suits without fans and electric-power source box, and by separately purchasing at least one set of fans and electric-power source box.

Incidentally, it is necessary for the air-streams in the second embodiment to be flown into the airflow passages by the two fans provided at those positions, which are slightly shifted from the right and left flank portions to the back portion of the cloth part. When the two fans are provided at those positions, which are slightly shifted from the right and left flank portions to the back portion of the cloth part, air-streams may flow in deviated paths within the airflow passages in such a manner to round about the central portions of the breast and back of the wearer, for example. Particularly, since the wearer is apt to perspire at the back portion, it is desirable to provide air-guiding means for guiding air-streams along predetermined paths within the airflow passages to pass the air-streams along the center of the back portion. Concretely, sponges are provided at predetermined positions on the cloth part to partition the spaces within the airflow passages, thereby causing the air-streams to flow within the airflow passages along the center of the back portion. It is also possible to use directional fans such as sirocco fans, thereby blowing the air-streams flowing within the airflow passages, toward the center of the back portion. Note that it is also enough to use the same method as the above, in case of causing the air-streams to pass along the center of the breast.

Although the second embodiment has been described for the situation where the upper portion of the cloth part is used as the air-permeating region while the two fans are provided at those positions which are slightly shifted from the right and left flank portions to the back portion of the cloth part, it is possible to use a region of the cloth part corresponding to one flank portion as the air-permeating region and to provide a single fan at a position of the cloth part corresponding to the other flank portion, for example. Generally, concrete mounting positions of the air-permeating region and fans (or air outlets) are arbitrary, insofar as the air-permeating region and fans are provided at mutually opposite positions across the airflow passages, respectively.

Further, although the second embodiment has been described for the situation where outside air is introduced into the airflow passages through the air-permeating region and the air-streams within the airflow passages are extracted to the exterior through the air outlets, it is possible to reversely use the air outlets as air inlets such that the outside air is introduced into the airflow passages through the air inlets and the air-streams within the airflow passages are extracted to the exterior through the air-permeating region.

Figure 11:
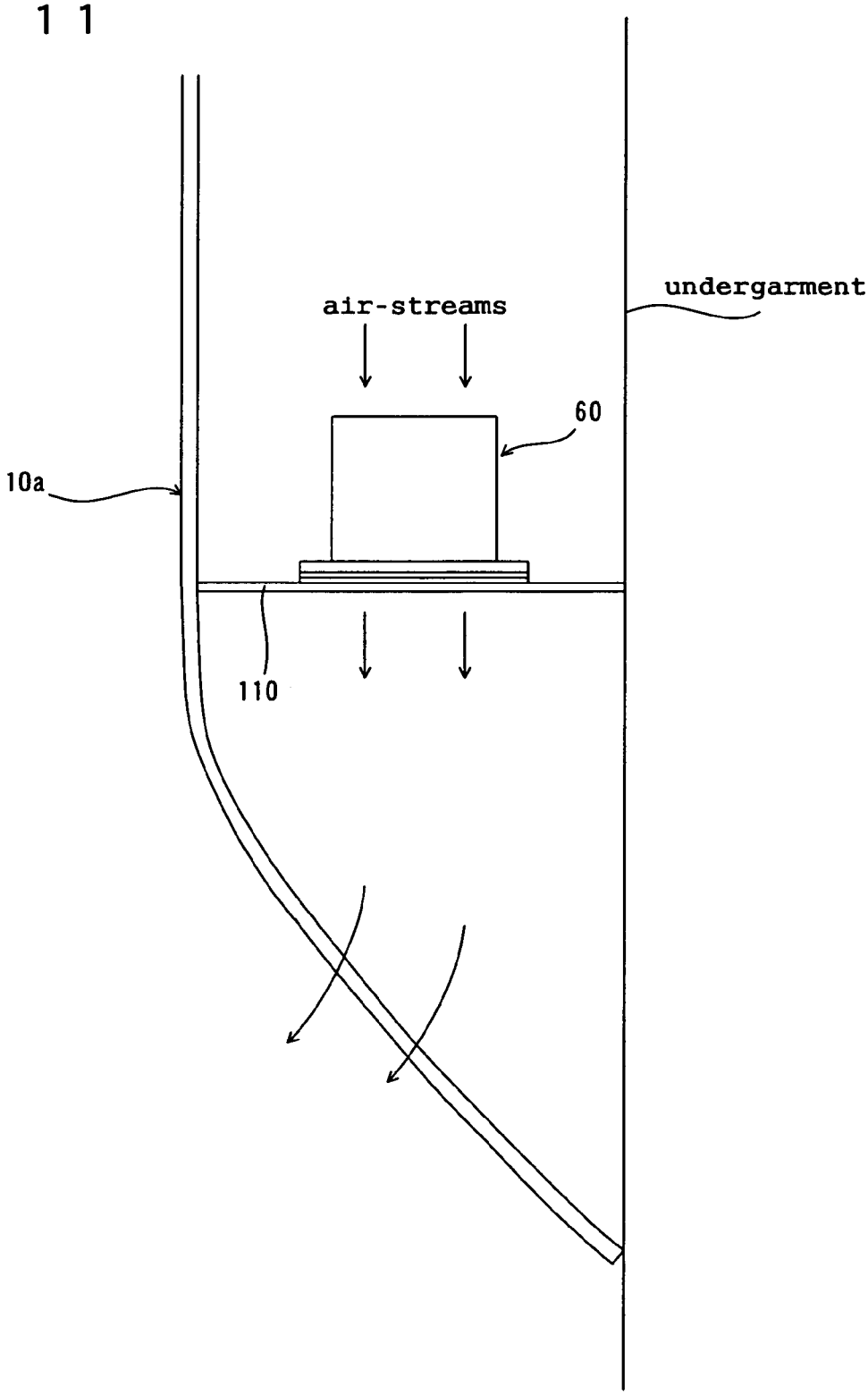
FIG. 11 is a view explaining a cooling suit according to a third embodiment of the present invention.

There will be explained hereinafter a third embodiment of the present invention with reference to the drawings. FIG. 11 is a view explaining a cooling suit according to a third embodiment of the present invention. Like reference numerals as used in the second embodiment are used in the third embodiment to denote those elements having the same functions as the second embodiment, and the detailed description thereof shall be omitted.

The cooling suit of the third embodiment comprises a cloth part 10*a*; two fans 60; an electric-power source box 90; and a band-like cloth (partitioning means) 110. Such a cooling suit is different from the second embodiment, in that air outlets to be formed by cutting out portions of the cloth part 10*a* are not provided while using a highly air-permeable material not only for the upper portion but also for the lower portion of the cloth part 10*a*, and in that the fans 60 are mounted between the cloth part 10*a* and an undergarment such that the rotational axes of the fans become substantially parallel to the surface of the undergarment. Other aspects are the same as those in the second embodiment.

The second embodiment has been described for the situation where the highly air-permeable material is used for the upper portion of the cloth part, and the air-impermeable material is used for portions other than the upper portion of the cloth part. Contrary, the third embodiment uses a highly air-permeable material for the upper portion and lower portion of the cloth part 10*a*, and uses a substantially air-impermeable material for the central portion other than the upper portion and lower portion of the cloth part. Hereafter, the region at the upper portion of the cloth part 10*a* where the highly air-permeable material is used shall be called a "first air-permeating region", and the region at the lower portion of the cloth part 10*a* where the highly air-permeable material is used shall be called a "second air-permeating region". Such first air-permeating region and second air-permeating region cooperatively corresponds to the "air ventilating portion" recited in claim 3. In the third embodiment, the first air-permeating region serves as an air inlet, and the second air-permeating region serves as an air outlet. Thus, it becomes unnecessary to form the air inlets and air outlet by cutting out portions of the cloth part 10*a*, so that the cooling suit of the third embodiment perfectly looks like a normal garment shirt when viewed from the exterior, without any incongruent feeling in the external appearance.

Further, although the structures of the fans 60 in the third embodiment are substantially the same as those of the second embodiment, the mounting manner of the fans 60 is different from the second embodiment. Namely, as shown in FIG. 11, the band-like cloth 110 is stitched onto the reverse side of the lower portion of the cloth part 10*a*, along the waistline direction. Herein, there is inserted a rubber string or the like through that edge portion of the band-like cloth which is opposite to the edge of the band-like cloth attached to the cloth part 10*a*, thereby shrinking gathers of the band-like cloth. Further, the two fans 60 are mounted at predetermined positions of the band-like cloth 110, respectively. Thus, the gathers of the band-like cloth 110 contact with the undergarment, and the central axes of the vane portion of the fans 60 become substantially parallel to the wearer's body surface upon wearing the cooling suit. In this way, the band-like cloth 110 serves to partition the space between the cloth part 10*a* and the undergarment into upper and lower partial spaces, and corresponds to the "partitioning means" recited in claim 3. Here, used as the fans 60 are small-sized ones each having a diameter of about 20 mm, for example. But, since it is desirable for the fans 60 to have larger air stream amounts to a certain extent, it is desirable to use fans 60 each having a thickness of 10 mm or more, for example. It is further possible to use a vertically elongated air blower such as bellows, instead of the fans 60. By mounting the fans 60 in such a manner, the air-streams passed through the airflow passages are fed downwardly by and through the fans 60, and then flowed to the exterior through the highly air-permeable lower portion (second air-permeating region) of the cloth part 10*a*. Note that it is enough for the cloth part positioned lower than the fans 60, to have a certain air-permeability. This is because, the low positioned cloth part 10*a* has a larger surface area so that the air-streams are allowed to flow out to the exterior without considerable resistances.

Note that although the third embodiment has been described for the situation where the outside air is introduced into the airflow passages through the upper portion (first air-permeating region) of the cloth part and the thus introduced air-streams are flowed from the above to the below, it is also possible that the fans are mounted on the band-like cloth in an upside-down manner and the outside air is introduced into the airflow passages through the lower portion (second air-permeating region) of the cloth part and the thus introduced air-flow are flowed from the below to the above. Since the air-streams within the airflow passages are heated by the body heat of the wearer to thereby cause upward air-streams, convecting air-streams and the like, it is rather desirable to cause the air-streams within the airflow passages to flow from the below to the above, from a standpoint of utilizing such upward air-streams or the like.

The cooling suit of the third embodiment exhibits the same functions and effects as those of the second embodiment. Particularly, in the cooling suit of the third embodiment, the outside air is introduced into the airflow passages and flowed out to the exterior by utilizing the material of the cloth part while providing the fans at the reverse surface side of the cloth part which is invisible from the exterior, thereby providing a feature that incongruent feeling in the external appearance is fully absent, even upon wearing the cooling suit.

Note that the cooling suit of the third embodiment may be applied to clothes (such as T-shirt, overalls and the like) of a type where the clothes are worn without bringing bottom portions thereof into the trousers or the like. In this case, it is not absolutely necessary to provide the second air-permeating region at the lower portion of the cloth part, because the lower end of the cloth part is opened. Namely, it is generally enough to provide the air-permeating region at least one of the upper portion and lower portion of the cloth part. Here, air-streams are to be extracted to the exterior by passing by the edge portion of the cloth part when the outside air is introduced into the airflow passages through the air-permeating region, while the outside air is to be introduced into the airflow passages by passing by the edge portion of the cloth part when the air-streams are extracted to the exterior through the air-permeating region.

Figure 12:
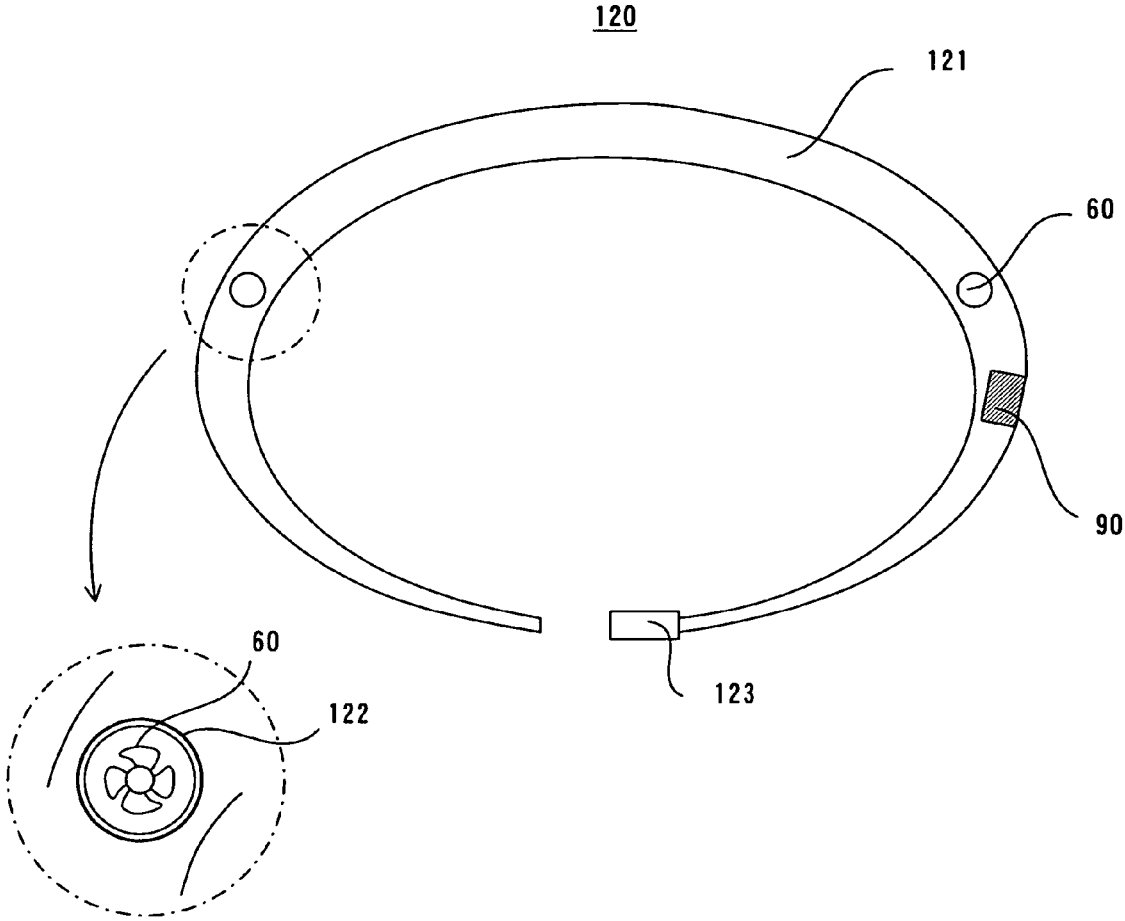
FIG. 12 is a schematic plan view of a belt to be used in a modified embodiment of the third embodiment of the present invention.
Figure 13:
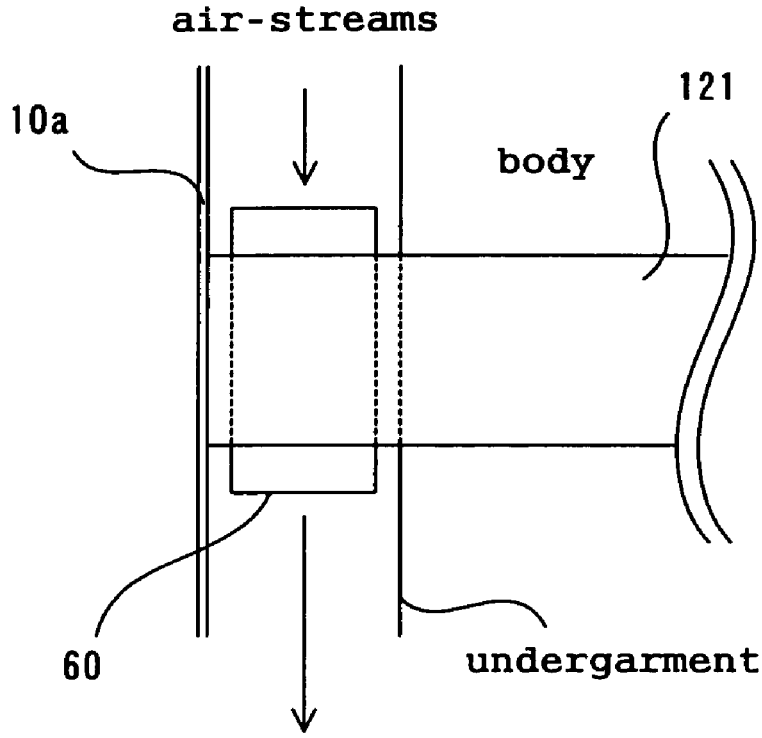
FIG. 13 is a schematic partial side view showing a mounted state of the belt of the modified embodiment.

Although the third embodiment has been described for the situation where the two fans are mounted on the predetermined positions by the band-like cloth 110, the present invention is not limited thereto and it is possible to use a specific belt as shown in FIG. 12 instead of the band-like cloth. FIG. 12 is a schematic plan view of the specific belt to be used in a modified embodiment of the third embodiment. Further, FIG. 13 is a schematic partial side view showing a mounted state of the specific belt 120 of this embodiment. Like reference numerals as used in the third embodiment are used in FIG. 12 and FIG. 13 to denote those elements having the same functions as the third embodiment, and the detailed description thereof shall be omitted. As shown in FIG. 12 and FIG. 13, the specific belt 120 of this embodiment comprises: a belt body 121; fan holders 122 for detachably attaching the fans 60 to the belt body; an electric-power source box 90; and a buckle 123. The belt body 121 is to ensure or hold airflow passages between the cloth part 10*a* and an undergarment, and to partition the airflow passages into upper and lower partial ones. Thus, the belt body 121 not only has a predetermined thickness in the up-and-down direction, but also has a sufficient width in the lateral direction so as to ensure the airflow passages and to retain the fans. Note that the belt body 121 has a narrower width near the buckle 123 as shown in FIG. 12, in order to reduce incongruent feeling due to the specific belt of this modified embodiment upon wearing the same. Further, used for the laterally wider portion of the belt body 121 is a light-weight material having a higher elasticity such as sponge. The specific belt 120 and the cloth part 10*a* may be closely contacted with each other by a magic tape, or the specific belt 120 may be detachably attached to the cloth part 10*a* by a fastener. Further, it is possible to wear a thin belt on the cloth to closely contact the specific belt and cloth part with each other.

Note that it is possible to wear a jacket of business suit or the like on the cooling suit of the present invention. In this case, it is desirable to fabricate those portions of such a jacket by a mesh-like material, for example, which correspond to the air inlets (the upper portion of the cloth part in case of the second embodiment) of the cooling suit and to the fans, respectively. In this way, the jacket never obstructs the air-streams concerning the cooling suit, thereby making it possible to maintain the excellent cooling effect by virtue of the cooling suit. Further, there have been recently sold jackets having excellent air-permeability as a whole. Such a jackets can be worn on the cooling suits, without any treatment. Note that jackets to be worn on the cooling suits are not limited to those of business suits.

Further, the cooling suit of the present invention can be applied to any clothes, without limited to work suits and dress shirts as mentioned in the first embodiment and second embodiment.

In addition to those noted above, the cooling suit of the present invention can be applied to: overalls; rain coats; military uniforms; garments for winter sports; agricultural and forestry work suits; garments for pilots and racers; and jackets for perspiratory animals.

The cooling suit of the present invention may have both: the mode for discharging the air-streams flowing within the airflow passages, into the direction perpendicular to the wearer's body, by providing the fans at those positions of the cloth part which correspond to the air outlets, as described in the first embodiment; and the mode for discharging the air-streams flowing within the airflow passages, in the downward direction from the lower portion of the cloth part, by providing the partitioning means with the fans, as described in the third embodiment. Such a cooling suit is advantageously capable of flowing a large amount of air-streams within the airflow passages.

Particularly, air resistances of the airflow passages can be reduced and the cooling effect can be more improved, by mounting such spacers capable of assuredly maintaining spaces at locations where the cloth is apt to closely contact with an undergarment, such as the upper back portion of the cloth part, as well as other locations which are important as airflow passages. As such spacers, smaller pieces of sponge or felt will do.

INDUSTRIAL APPLICABILITY

As described above, the present invention is to flow air-streams within the airflow passages between the cloth part and an undergarment in a manner substantially parallel to the wearer's body surface so as to increase the temperature gradient near the wearer's body surface to thereby cool the wearer's body, and, such as in a perspiring situation, to thereby carry the perspiration to the exterior by the air-streams flowing within the airflow passages thereby directly cooling the wearer's body by absorbing the evaporation heat by the perspiratory effect, so that the present invention can be applied to garments to thereby allow the wearer to feel comfortableness with a reduced power consumption and a simple structure.

The invention claimed is:

1. A cooling suit to be worn on a wearer, comprising:

a cloth part;

at least one air inlet provided at said cloth part and configured to introduce outside air into the interior of said cloth part;

at least one air outlet provided at said cloth part and configured to extract the air within the interior of said cloth part to the exterior;

at least one air-blowing means for discharging the air in a space between said cloth part and the wearer's body or an undergarment to the exterior, thereby forcibly causing air-streams within said space;

at least one clearance holding means, provided to cover that surface of the at least one air-blowing means which opposes to the wearer's body or to the undergarment, and configured to hold a predetermined clearance between the at least one air-blowing means and the wearer's body or the undergarment;

electric-power source means for supplying electric power to the at least one air-blowing means; and air-leakage preventing means for preventing the air-streams flowing between said cloth part and the wearer's body or the undergarment, from leaking to the exterior from a lower end of said cloth part;

wherein the at least one air-blowing means introduces the outside air into the interior of said cloth part through the at least one air inlet to cause the introduced air to flow within said space and substantially parallel to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away evaporation heat from the surroundings upon evaporation of the perspiration.

2. A cooling suit to be worn on a wearer, comprising:

a cloth part;

at least one air inlet provided at a lower portion of said cloth part and configured to introduce outside air into the interior of said cloth part;

at least one air outlet provided at an upper portion of said cloth part and configured to extract the air within the interior of said cloth part to the exterior;

at least one sideward-flow fan configured to feed outside air into a space between said cloth part and the wearer's body or an undergarment, thereby forcibly causing air-streams within said space;

electric-power source means for supplying electric power to the at least one air-blowing means; and air-leakage preventing means for preventing the air-streams flowing between said cloth part and the wearer's body or the undergarment, from leaking to the exterior from a lower end of said cloth part;

wherein the at least one sideward-flow fan introduces the outside air into the interior of said cloth part through the at least one air inlet to cause the introduced air to flow within said space and substantially parallel to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away evaporation heat from the surroundings upon evaporation of the perspiration.

3. A cooling suit to be worn on a wearer, comprising:

a cloth part;

at least one air-flow opening provided at said cloth part and configured to extract air within the interior of said cloth part or to introduce outside air into the interior of said cloth part;

at least one air-blowing means, provided at that position of said cloth part which corresponds to the at least one air-flow opening, and configured to forcibly cause air-streams in a space between said cloth part and the wearer's body or an undergarment;

electric-power source means for supplying electric power to the at least one air-blowing means; and an air-permeating region which is a predetermined region of said cloth part positioned opposite to the at least one air-flow opening across said space and which is made of a highly air-permeable material;

wherein the at least one air-blowing means introduces the outside air into said space through the at least one air-flow opening or through said air-permeating region to cause the introduced air to flow within said space and substantially parallel to a wearer's body surface, thereby increasing a temperature gradient near the wearer's body surface to thereby cool the wearer's body, and thereby contacting the air-streams flowing within said space with perspiration from the wearer's body so as to vaporize the perspiration from the wearer's body to thereby cool the wearer's body by utilizing an effect to take away evaporation heat from the surroundings upon evaporation of the perspiration.

4. The cooling suit of any one of claims 1, 2, and 3, further comprising air guiding means provided within said space and for flowing the air-streams along predetermined paths within said space.

5. The cooling suit of any one of claims 1, 2, and 3, wherein said electric-power source means comprises a fuel cell.

6. The cooling suit of any one of claims 1, 2, and 3, wherein said electric-power source means supplies electric power to the at least one air-blowing means via cord.

7. The cooling suit of any one of claims 1, 2, and 3, further comprising a controlling circuit and a receiving circuit, wherein said electric-power source means, said controlling circuit and said receiving circuit are associated with the at least one air-blowing means, and wherein the driving operation of the at least one air-blowing means is controlled by wirelessly transmitting a signal to said receiving circuit from exterior transmitting means.

8. The cooling suit of any one of claims 1, 2, and 3, further comprising a controlling circuit and a receiving circuit both associated with the at least one air-blowing means, wherein the driving operation of the at least one air-blowing means is controlled by wirelessly transmitting a signal to said receiving circuit from exterior transmitting means.

9. The cooling suit of any one of claims 1, 2 and 3, wherein the at least one air-blowing means is mounted on a reverse side of said cloth part in a manner that the rotational axis of the at least one air-blowing means is substantially perpendicular to a surface of the wearer's body or of the undergarment.

10. The cooling suit of any one of claims 1, 2 and 3, wherein the at least one air-blowing means is mounted at a predetermined position of a reverse side of said cloth part, so that, that end surface of the at least one air-blowing means which opposes said cloth part, is substantially flush with an obverse surface of said cloth part.

11. The cooling suit of any one of claims 1, 2 and 3, wherein the at least one air-blowing means is provided at that position of said cloth part, which is slightly shifted from the flank portion to the back portion of said cloth part.

12. The cooling suit of claim 3, wherein the at least one air-blowing means is a sideward-flow fan mounted at a predetermined position of a reverse surface of said cloth part.

13. The cooling suit of claim 3, wherein said cloth part has an upper portion acting as said air-permeating region.

14. The cooling suit of any one of claims 1, 2, and 3, further comprising a fastener or magic tape as means for opening and closing a front portion of said cloth part.

15. The cooling suit of any one of claims 1, 2, and 3, wherein said cloth part is made of a material without water absorptivity.

16. The cooling suit of any one of claims 1, 2, and 3, wherein said cloth part has a heat ray reflecting treatment applied thereto.

17. The cooling suit of any one of claims 1, 2, and 3, further comprising a spacer configured to ensure said space, said spacer being mounted on a reverse side of said cloth part at a region where said cloth part and the wearer's body or undergarment are apt to closely contact with each other.

18. The cooling suit of claim 2, wherein the at least one air outlet has a laterally elongated cut-out provided at an upper portion of a back portion of said cloth part, and wherein said cut-out is covered by a mesh, or said cooling suit further comprises at least one spacer arranged around said cut-out.

* * * * *